United States Patent [19]

Firey

[11] Patent Number: 4,568,361

[45] Date of Patent: Feb. 4, 1986

[54] CYCLIC CHAR GASIFIER OXIDATION PROCESS

[76] Inventor: Joseph C. Firey, P.O. Box 15514, Seattle, Wash. 98115

[21] Appl. No.: 679,541

[22] Filed: Dec. 7, 1984

Related U.S. Application Data

[60] Continuation-in-part of Ser. No. 492,484, May 6, 1983, abandoned, which is a division of Ser. No. 328,148, Dec. 7, 1981, abandoned, which is a continuation-in-part of Ser. No. 121,973, Feb. 15, 1980, abandoned.

[51] Int. Cl.[4] ..... C10J 3/04

[52] U.S. Cl. ..... 48/197 R; 48/203; 48/206; 48/DIG. 6

[58] Field of Search ..... 48/197 R, 203, 206, 48/61, 63, 64, 76, 86 R, DIG. 6; 44/1 F, 2; 166/305; 60/39.04, 39.12, 39.17

[56] References Cited

U.S. PATENT DOCUMENTS 1,733,623 10/1929 O'Connor ..... 48/203
4,085,578 4/1978 Kydd ..... 48/63

*Primary Examiner*—Peter Kratz

[57] ABSTRACT

A cyclic char gasifier process and apparatus are described wherein reactant gases are first compressed into the pores of a char fuel to react and then the reacted gases are expanded out of the char fuel pores. This cycle of compression and expansion is repeated with fresh reactant gases supplied for each compression and with reacted gases removed at each expansion. Air and steam are preferred reactant gases when the char fuel is to be gasified by oxidation. Reacted gases from such an oxidation gasifier plant are preferred reactant gases when the char fuel is to be partially gasified by devolatilization. Rapid reaction to a rich product gas can occur over the large surface area inside the char pores and the undesirable Neumann reversion reaction is suppressed by the strongly reducing conditions prevailing therein. The gases of devolatilization gasification can be used to enrichen the gases of oxidation gasification by using two cyclic char gasifier plants in a combination system. The char fuel can be placed into sealed pressure vessel containers or can be gasified in place within an underground coal formation. These cyclic char gasifier plants and systems can produce a network output, one or more fuel gases, a devolatilized char, and a partially oxidized coke as principal products and the proportions of these products can be adjusted over a wide range to match market needs.

8 Claims, 17 Drawing Figures

CYCLIC CHAR GASIFIER OXIDATION PROCESS

The invention described herein is related to my following U.S. patent applications:

(a) "Char Burning Free Piston Gas Generator," U.S. Pat. No. 4,372,256;

(b) "Further Improved Char and Oil Burning Engine," U.S. Pat. No. 4,412,511;

(c) "Torque Leveller," U.S. Pat. No. 4,433,547;

(d) "Cyclic Solid Gas Reactor," Ser. No. 06/473,566, filing date 9 Mar. 1983;

(e) "Cyclic Velox Boiler," U.S. Pat. No. 4,455,837;

(f) "Cyclic Velox Boiler," Ser. No. 06/579,562, filed 13 Feb. 1984, now U.S. Pat. No. 4,484,531, a process divisional application from U.S. Pat. No. 4,455,837;

(g) "Cyclic Char Gasifier With Product Gas Divider," Ser. No. 06/628,150 now U.S. Pat. No. 4,533,362.

BACKGROUND OF THE INVENTION

1. Field of the Invention

This invention is in the field of coal gasifier processes and apparatus, and particularly apparatus capable of carrying out these processes by means of cyclic compression and expansion of reactant gases into and reacted gases out of the pores of the coal or other char fuel.

2. Description of the Prior Art

Gasification of char fuels, particularly coal, has been carried on for many years by use of several differing kinds of apparatus as is discussed in some detail in, for example, reference A. The most common prior art schemes gasify coal either by a devolatilization process of removing volatile portions, or by an oxidation process of oxidizing non-volatile carbon to gaseous carbon monoxide, or by a combination of these schemes.

Coal is transformed into solid coke and coke oven gas in coke ovens via a high temperature devolatilization process. The available evidence suggests that simple evaporation of volatile coal components is an important part of devolatilization but that other processes including reactions are also important as is shown by a slight net exothermic heat of reaction for devolatilization. Other char fuels have also been commercially devolatilized in a similar manner such as wood and heavy oil.

Coal, coke and wood charcoal have been transformed into producer gas in gas producers via air oxidation of solid carbon to gaseous carbon monoxide. This overall gasification reaction can be represented by the following reaction balance:

$$2C+O_2+3.76N_2 \rightarrow 2CO+3.76N_2+(QCO)$$

The net exothermic heat of this reaction, QCO, is of the order of 96000 Btu per lb. mol of oxygen consumed. Where the producer gas is to be utilized elsewhere at a distance, a large portion of this appreciable net heat of reaction can be lost unless the hot producer gas is cooled as by generating steam.

Essentially this same char gasification reaction has also been carried out using pure oxygen or oxygen-enriched air, on an experimental basis, in order to reduce the content of inert nitrogen in the final product gas.

Coke and wood charcoal have been transformed into water gas via steam oxidation of solid carbon to carbon monoxide and hydrogen. This overall gasification reaction can be represented by the following reaction balance.

$$C+H_2O \rightarrow CO+H_2+(QH)$$

The net endothermic heat of this reaction, QH, is of the order of 55273 Btu per lb. mol of steam reacted. Since this reaction is endothermic, it is necessary to first heat up the carbon to a high temperature before applying the steam and this cycle of preheat followed by steaming is repeated.

Combinations of air oxidation with steam oxidation are also used for gasification of char fuels. Also, the several gases created, producer gas, water gas and coke oven gas, have been blended together and with other gases, after production, to create special gas fuel properties.

A primary shortcoming of producer gas has been its low volumetric heating value (circa 120 Btu per cu. ft. at STP) due to the high content of inert nitrogen. Consequently, producer gas cannot be economically pumped through pipe lines for any great distance. At some distance, the pumping power required per cu. ft. of gas will exceed the gas heating value.

Water gas possesses an intermediate volumetric heating value (circa 280 Btu per cu. ft. at STP) due to the high content of hydrogen. Hence, water gas can be economically pumped through pipelines of moderate distance.

The gases of devolatilization possess high volumetric heating values (circa 550 Btu per cu. ft. at STP) due to the moderate content of gaseous hydrocarbons, and these gases can be economically pumped considerable distances.

A gas of high volumetric heating value is commonly and herein referred to as a "rich" gas whereas a gas of low volumetric heating value is commonly and herein referred to as a "lean" gas.

The term char fuel is used herein and in the claims to include any carbon containing fuel which is either a solid or can be transformed partially into a carbonaceous solid when devolatilized. Included as char fuels within this definition are coal, coke, wood, wood charcoal, oil shale, petroleum coke, heavy petroleum fuels such as bunker C, garbage, wood bark, wood wastes, agricultural wastes, and other carbonaceous materials, together with mixtures of these char fuels. Note that a char fuel is both an input and an output of such devolatilization processes as coke ovens and charcoal ovens.

The term oxygen and oxygen gas refer to molecular oxygen as $O_2$ and a gas containing oxygen in appreciable quantities, such as air, is referred to as a gas containing appreciable oxygen whereas a gas, such as producer gas or water gas, containing very little oxygen, is referred to as a gas essentially free of oxygen even though it may contain appreciable portions of atoms of oxygen combined with carbon and hydrogen.

Herein and in the claims those gases put into a char gasifier scheme and into contact with char fuel therein are referred to as reactant gases whereas those gases which emerge from contact with the char fuel and are removed therefrom are referred to as reacted gases. In a gas producer, for example, air is a reactant gas and the producer gas is a reacted gas.

Much coal lies in seams too thin and too deep to be economically mined and recently some efforts have been directed to gasifying such thin seam coals in place underground. Most of these underground gasification processes admit air and other reactants into the coal seam via one borehole and extract the product of reacted gases via another borehole some distance away. Hence, throughflow of gases between boreholes is required. When air is used as reactant gas, a single reacted gas emerges which is of low volumetric heating value and hence useable only in the vicinity of the coal seam. This throughflow requirement and the low heating value of the reacted gas are among the deficiencies of prior art underground char gasification schemes.

Other deficiencies of prior art char gasification systems include: a requirement for net work input to drive pumps, blowers, etc.; loss of all or a major portion of the net heat of the gasification reaction; slowness of the gasification reaction since reaction occurs largely on only the external char surface area; loss of volumetric heating value due to occurrence of the Neumann reversion reaction where steam is used. This latter, Neumann reversion reaction, can be represented by the following reaction balance:

$$CO+H_2O \rightarrow CO_2+H_2$$

and occurs principally in the absence of reducing conditions where both CO and steam are present. The resulting inert and non-condensible $CO_2$ acts to reduce the volumetric heating value of the product reacted gas.

References:

A. "Coal, Coke and Coal Chemicals," P. J. Wilson and J. H. Wells, McGraw-Hill, 1950

B. "Steam," Babcock and Wilcox Co., 38th Ed., 1972

C. "Combustion, Flames and Explosions of Gases," B. Lewis and G. Von Elbe, Academic Press, 1961

D. "Cryogenic Systems," Barron, McGraw-Hill

E. "Chemistry and Technology of Synthetic Liquid Fuels," Second Edition, Nat'l. Science Foundation by Israel Program For Scientific Translations, 1962

F. British Pat. No. 492,831 of 28 Sept. 1938

G. U.S. Pat. No. 2,714,670 of 2 Aug. 1955

H. U.S. Pat. No. 4,047,901 of 13 Sept. 1977

I. U.S. Pat. No. 1,913,395 of 13 June 1933

J. U.S. Pat. No. 1,992,323 of 26 Feb. 1935

K. U.S. Pat. No. 3,734,184 of 22 May 1973

L. U.S. Pat. No. 2,225,311 of 17 Dec. 1940

M. U.S. Pat. No. 2,624,172 of 6 Jan. 1953

N. U.S. Pat. No. 4,085,578 of 25 Apr. 1978

O. U.S. Pat. No. 2,675,672 of 20 Apr. 1954

SUMMARY OF THE INVENTION

The apparatus of this invention comprises combinations of reactant gas compressors, two or more char fuel containers, and reacted gas expanders together with means for connecting each container in turn first to the compressor and then to the expander. With this apparatus the char fuel within the containers is first compressed with fresh reactant gases and the reacted gases resulting are then expanded out of the char fuel pores, and this cycle is repeated. The char fuel within the containers may be partially gasified when the reactant gases are relatively inert hot gases which will remove the volatile matter from the char fuel and this apparatus is termed a devolatilization gasifier. The char fuel within the containers may be essentially completely gasified to carbon monoxide when the reactant gases are air and, if steam be added to the air, hydrogen will also be produced and this apparatus is termed an oxidation gasifier. Preferably, the expander is an expander engine capable of producing work and for oxidation gasifiers this expander work can exceed the work of compression and a net work output results which is one of the beneficial objects of this invention. When such work expanders are used, air and steam are preferably used together as reactant gases for oxidation gasifiers in order to keep the gas temperatures at the expander within the capabilities of available expander materials, and a steam boiler or other source of steam becomes part of the plant. The expanded product gases from an oxidation gasifier are the preferred reactant gases for devolatilization gasifiers where they will be enriched and in this way two or more cyclic char gasifier plants may be used advantageously in combination. The containers for the char fuel may be sealed pressure vessels or an underground coal formation may be used, in place, as a container and these two types of containers may be used separately or in combination. A wide range of char fuels can be gasified in the cyclic char gasifiers of this invention including coal, wood, oil shale, Bunker C oils, and other carbonaceous materials and these char fuels can be used alone or in combination. From these char fuels a wide variety of useful products can be produced such as; two or more fuel gases of which at least one can be highly enriched, a devolatilized char fuel product, a partially oxidized coke fuel product, electric power. The relative amounts of these several product outputs can be varied over a wide range to match up available char fuel resources to market needs and this is a further beneficial object of this invention.

BRIEF DESCRIPTION OF THE DRAWINGS

An example of a sealed pressure vessel containing means is shown in FIG. 1 equipped with one type of refuel mechanism and one type of coke removal mechanism.

A very simple cyclic char gasifier plant is shown schematically in FIG. 2 with a compressor, 70, and drive motor, 71, two containers, 1, 72, an expander, 76, and connecting means between these elements.

Figure 3:
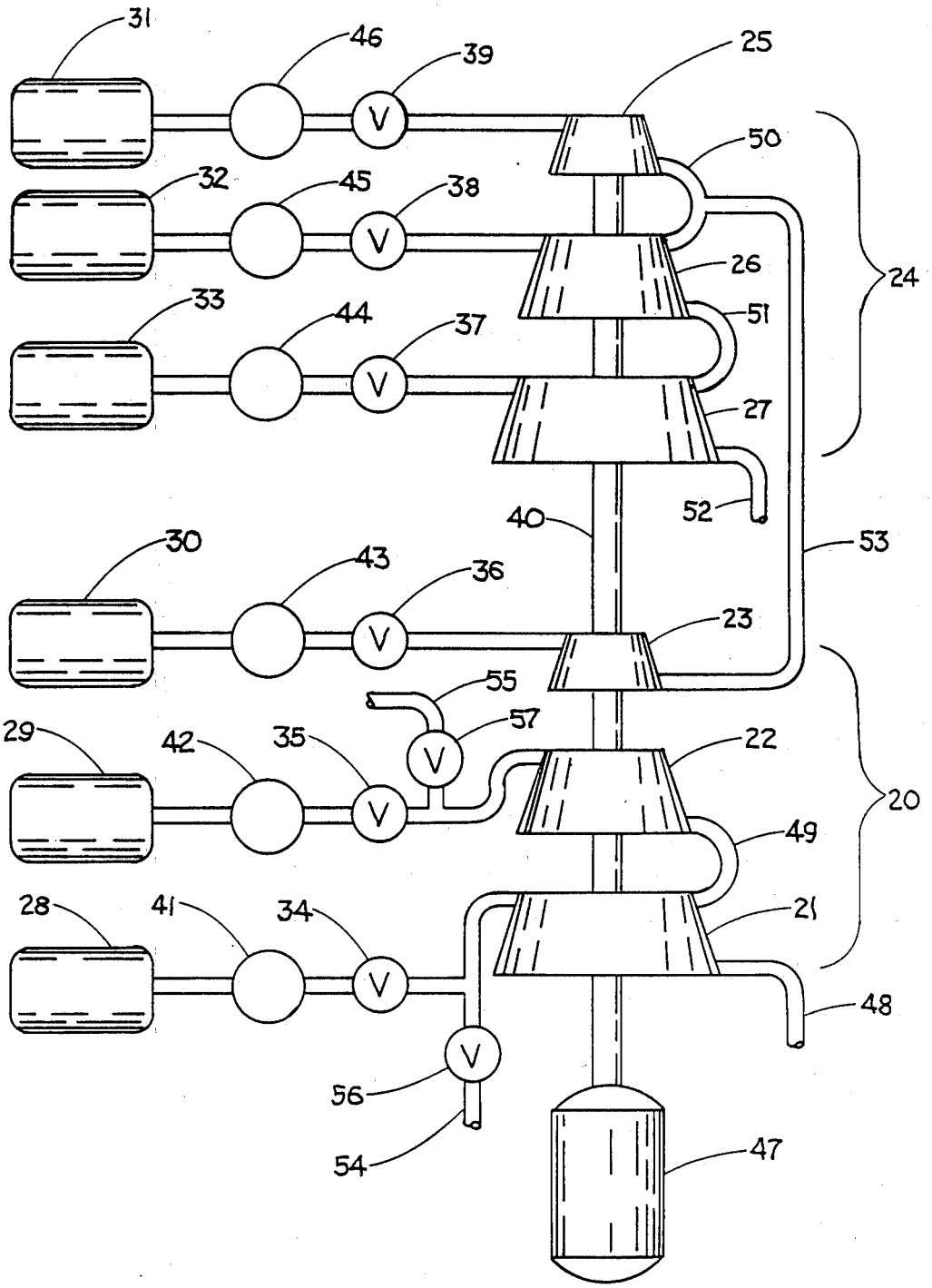
Figure 4:
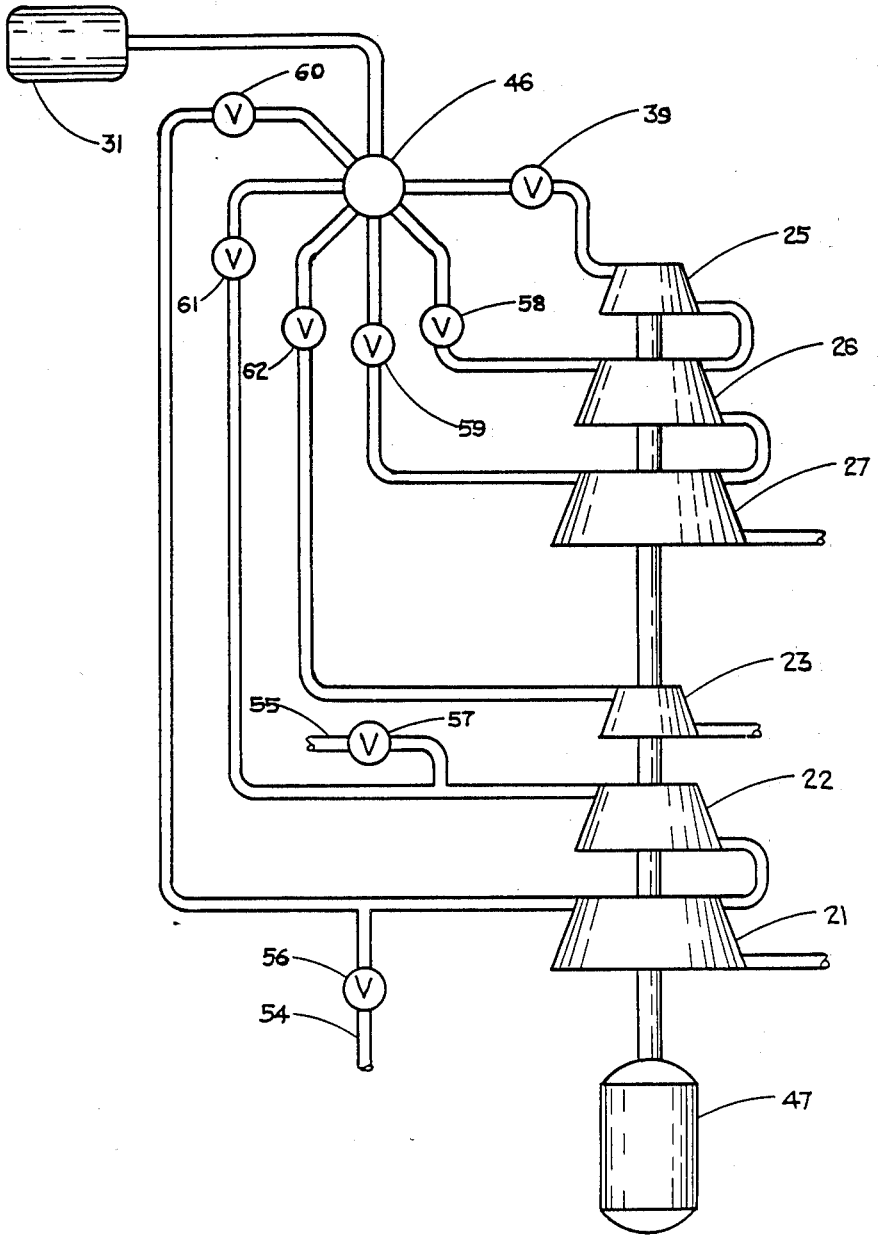

A cyclic char gasifier plant using a multistage compressor and a multistage expander with several containers is shown schematically in FIG. 3 together with some of the connecting means between elements. Some of the additional connecting means for a single container are shown in FIG. 4 for the same plant as shown in FIG. 3.

Figure 5:
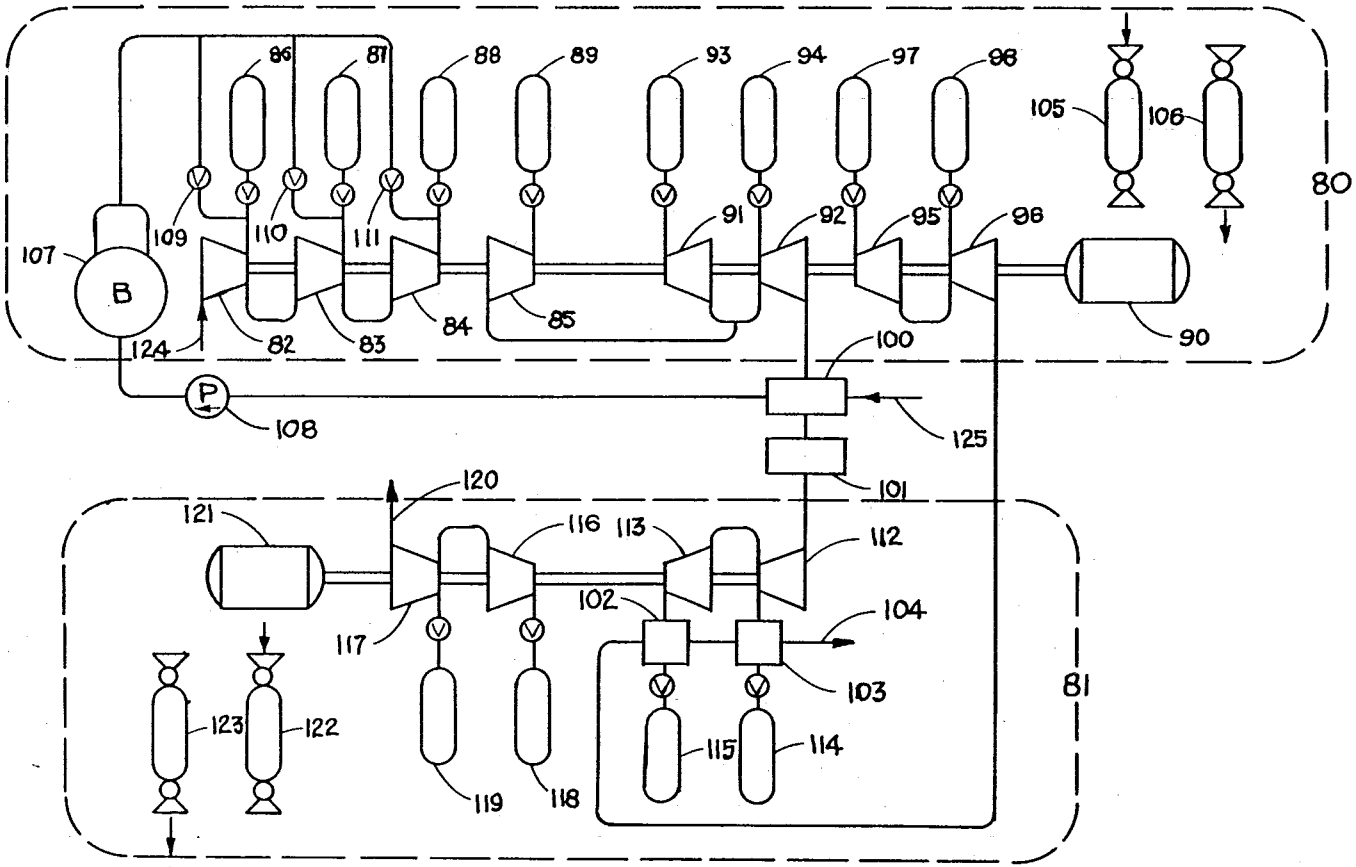

A devolatilization-oxidation cyclic char gasifier system is shown in the simplified schematic diagram of FIG. 5 with an oxidation gasifier plant, 80, connected functionally in combination with a devolatilization gasifier plant, 81.

Figure 6:
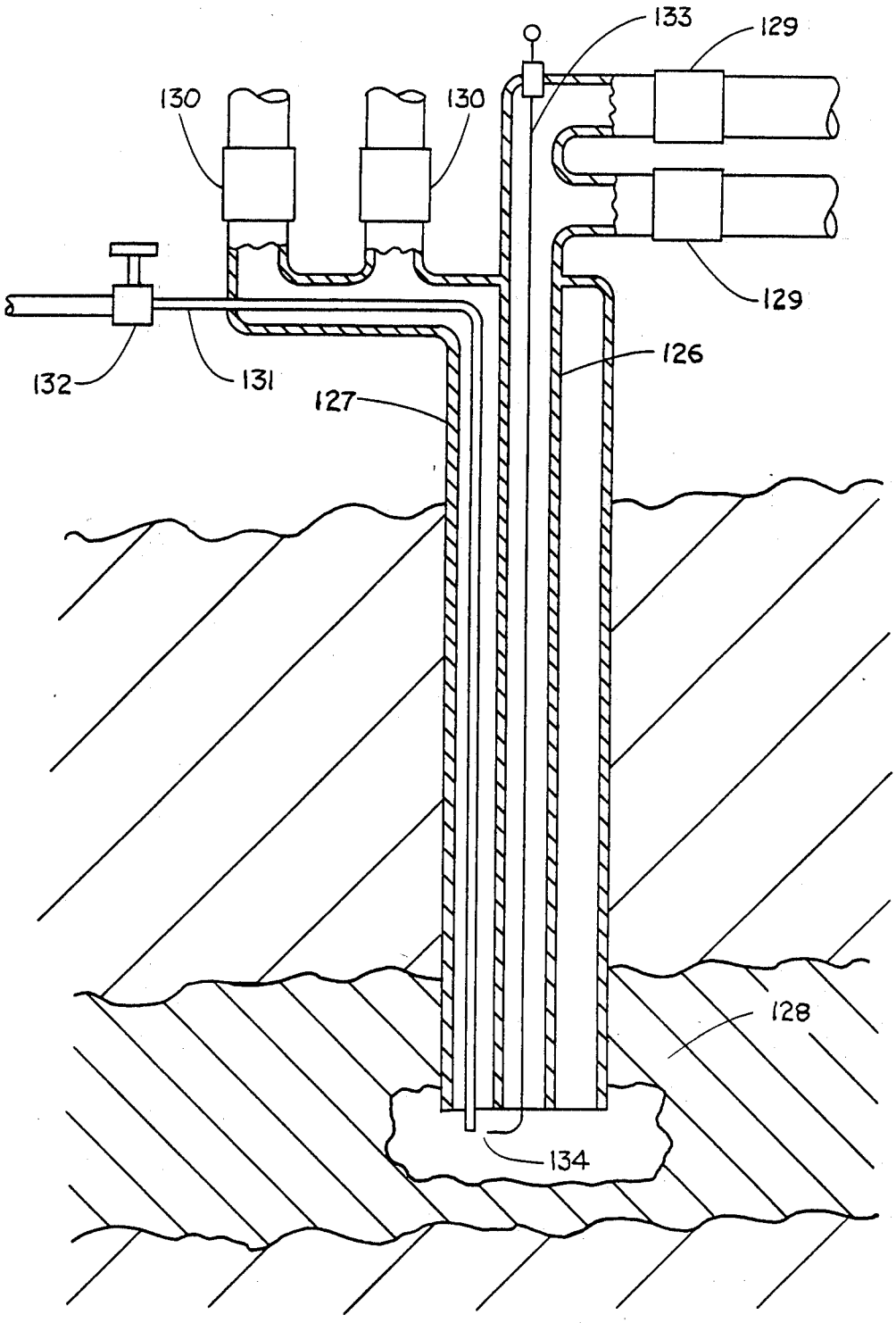

A double pipe borehole for using underground coal seams, 128, as containers is shown in FIG. 6 together with a char heating means for startup.

Figure 7:
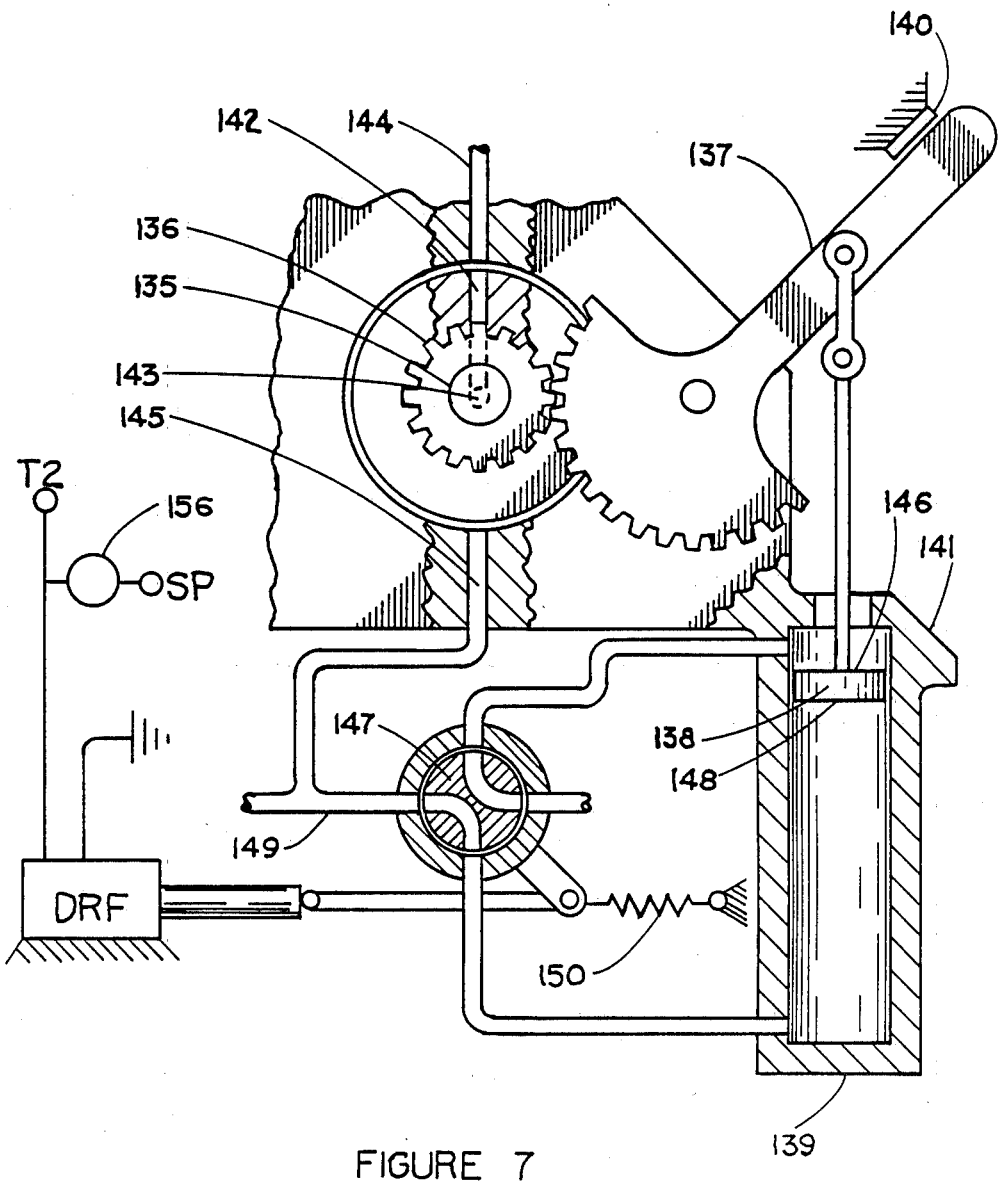
Figure 8:
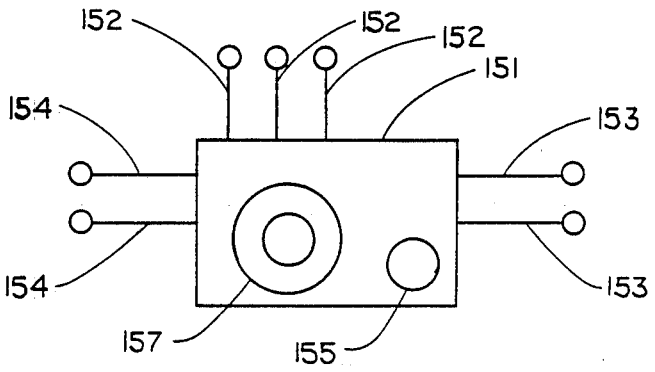

A means for connecting and disconnecting a refuel mechanism or a coke removal mechanism is shown in FIG. 7. An ash level sensor control for use with a coke removal mechanism, such as that of FIG. 7, is shown in FIG. 8.

Figure 9:
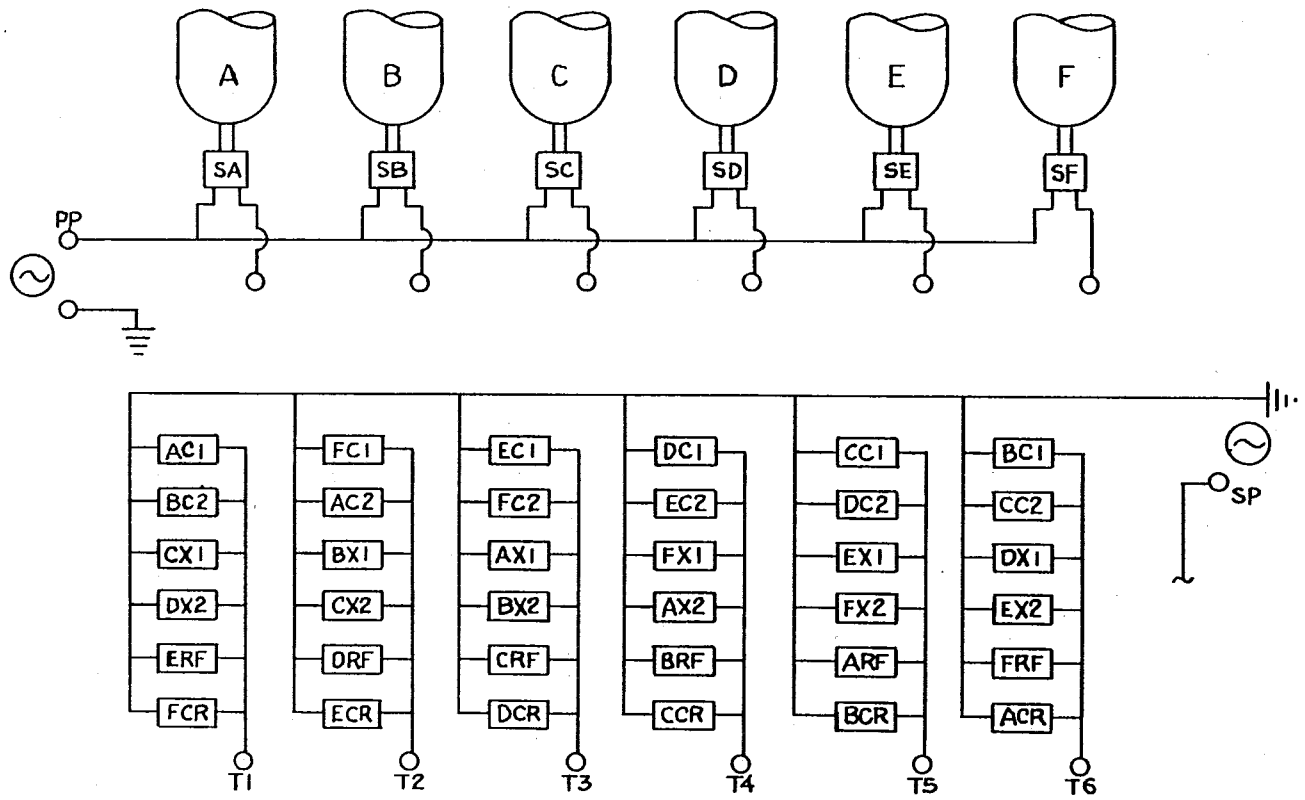
Figure 10:
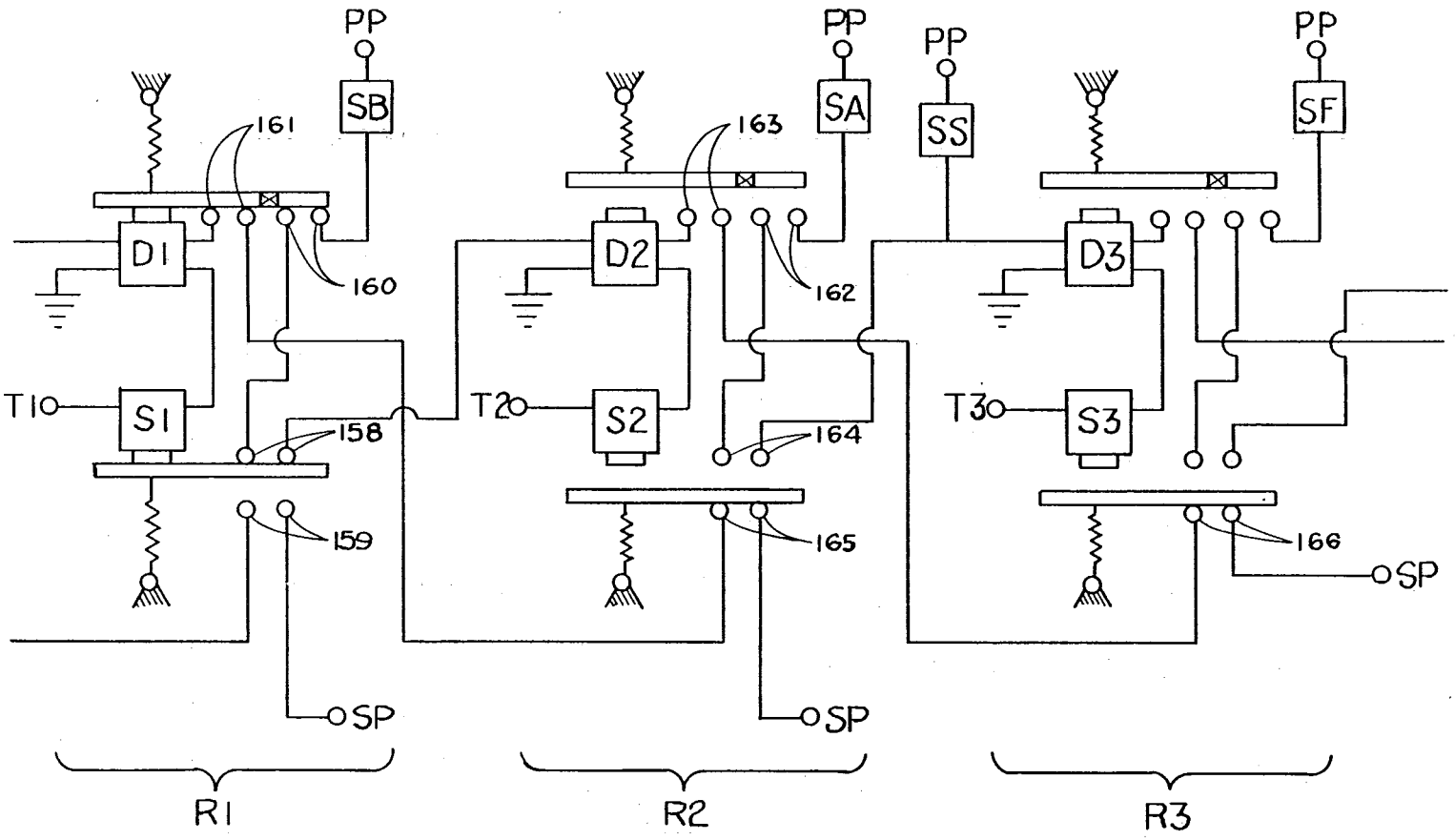

A means for opening and closing the several solenoid valves connecting containers to compressors and expanders is shown schematically in FIG. 9, and the cascaded relay system shown in FIG. 10 assures desired continuity of the sequence of such connections and refuelings and coke removals.

Figure 11:
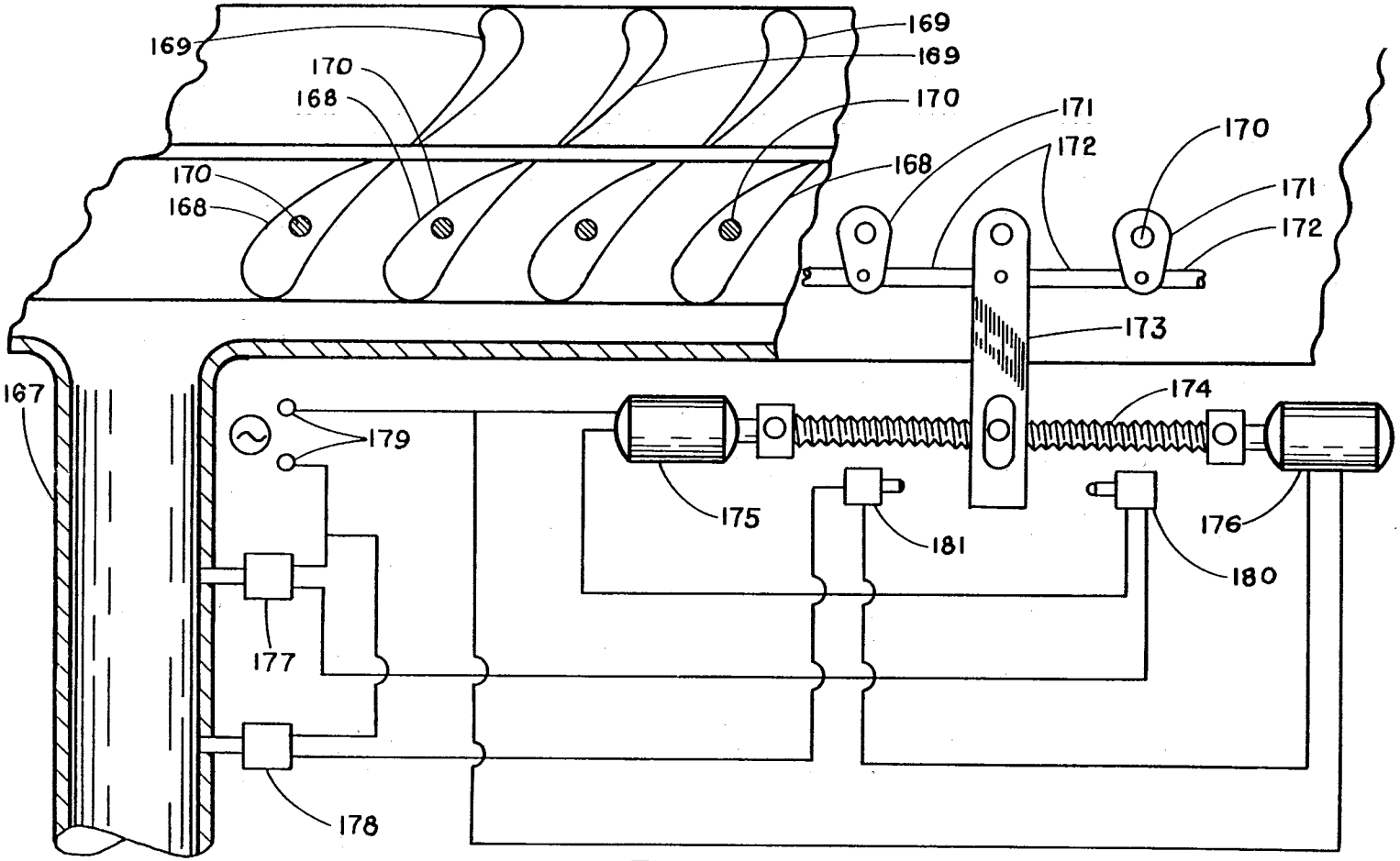

A means for adjusting the flow rate of reacted gas through an expander is shown in FIG. 11.

Figure 12:
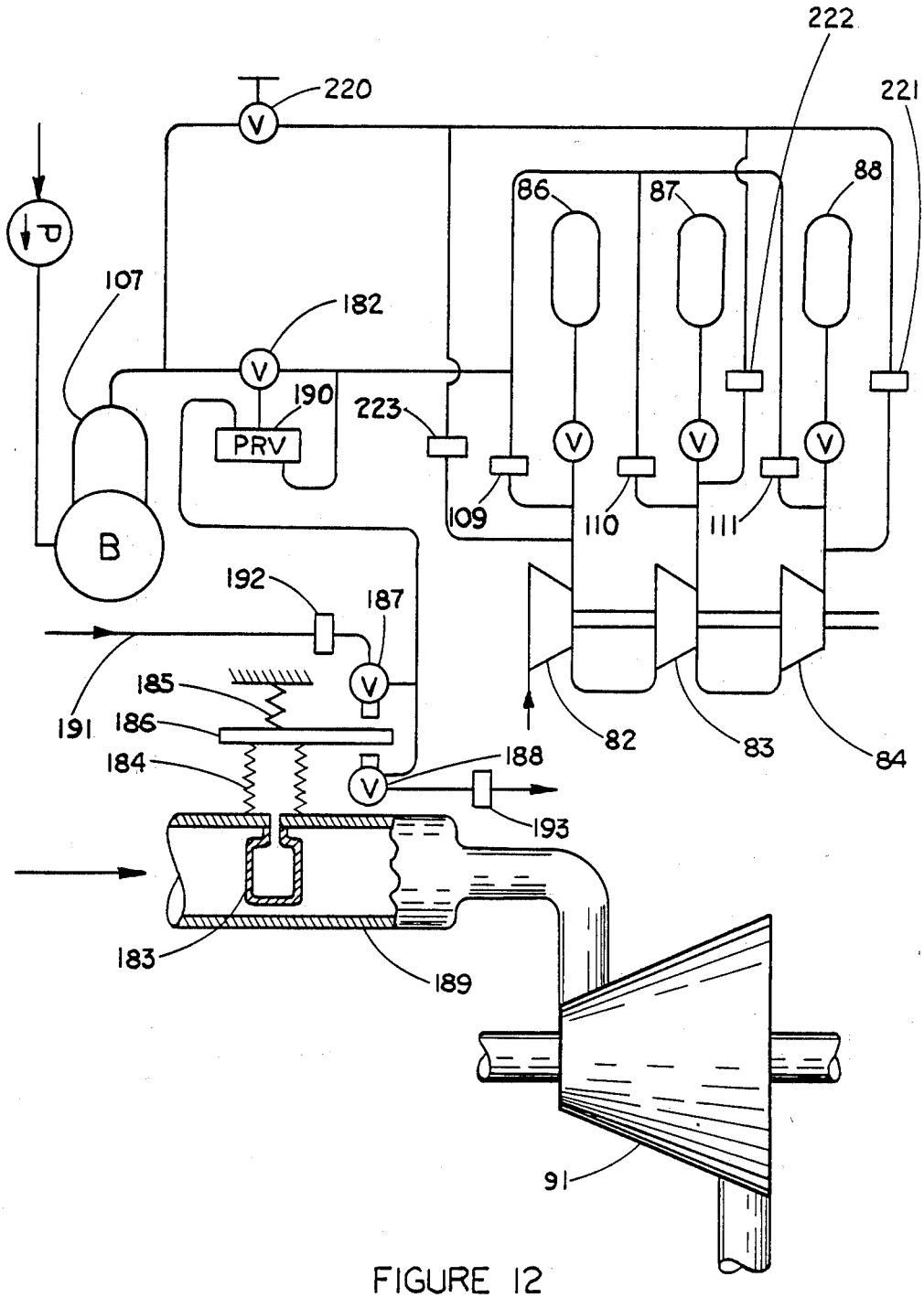

A means for controlling expander inlet temperatures via control of steam flow into oxidation gasifier containers is shown schematically in FIG. 12 together with a steam stopping means.

Figure 13:
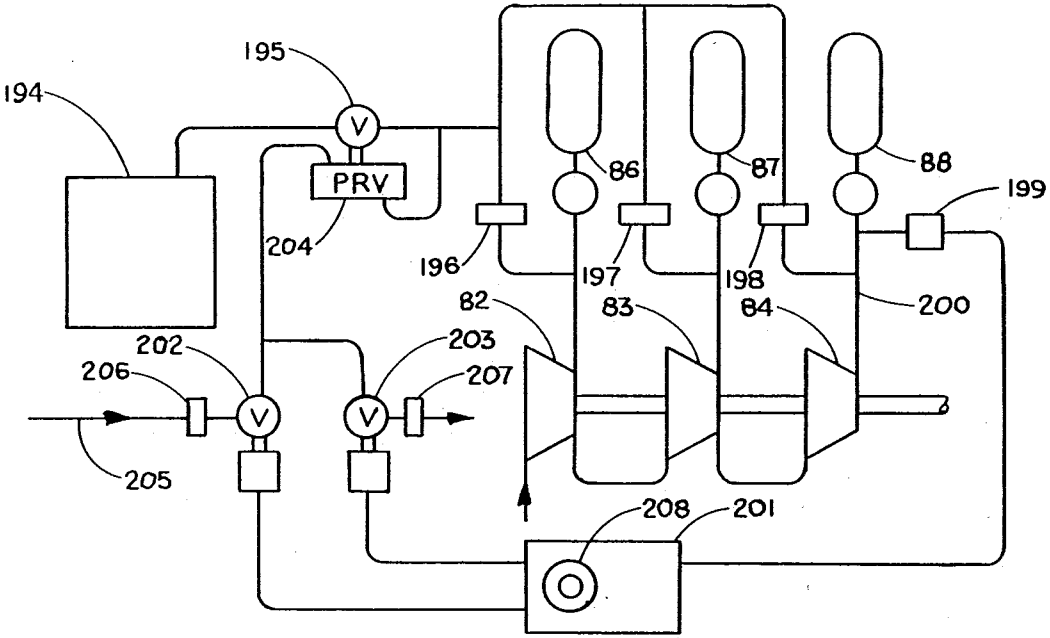

A means for controlling the oxygen to nitrogen ratio when oxygen enrichment is used is shown schematically in FIG. 13.

Figure 14:
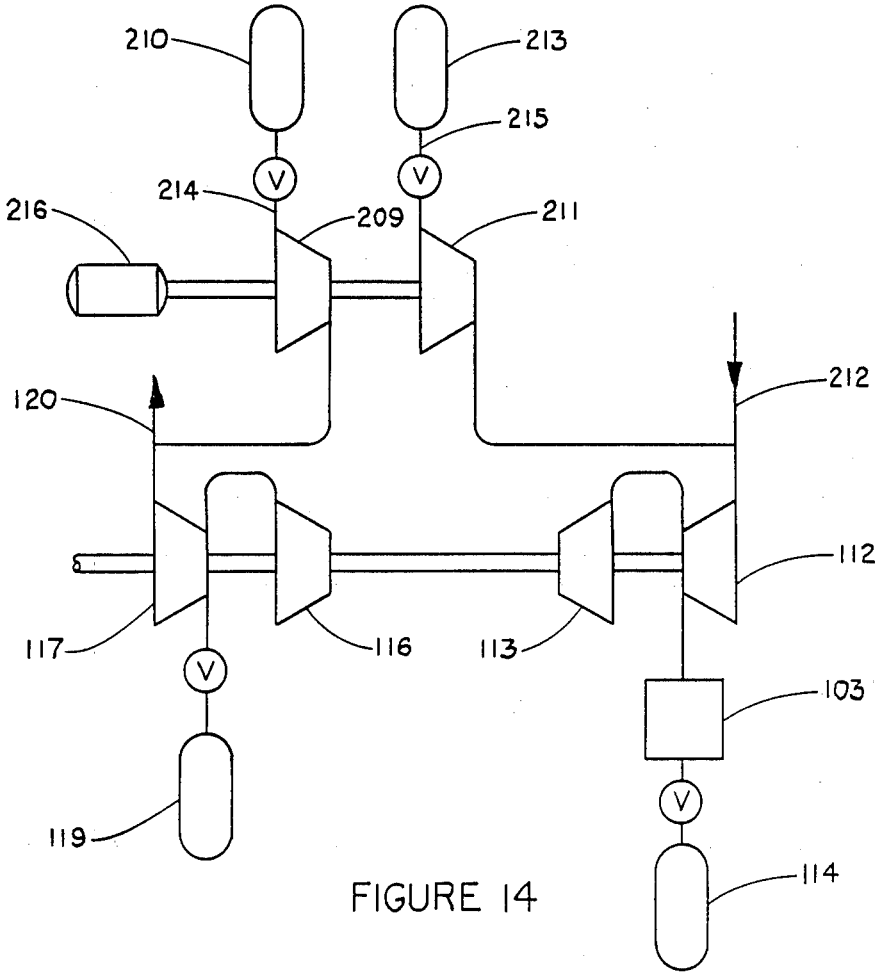

A scheme for utilizing vacuum pumps and vacuum expanders with devolatilization gasifier plants is shown in FIG. 14.

Figure 15:
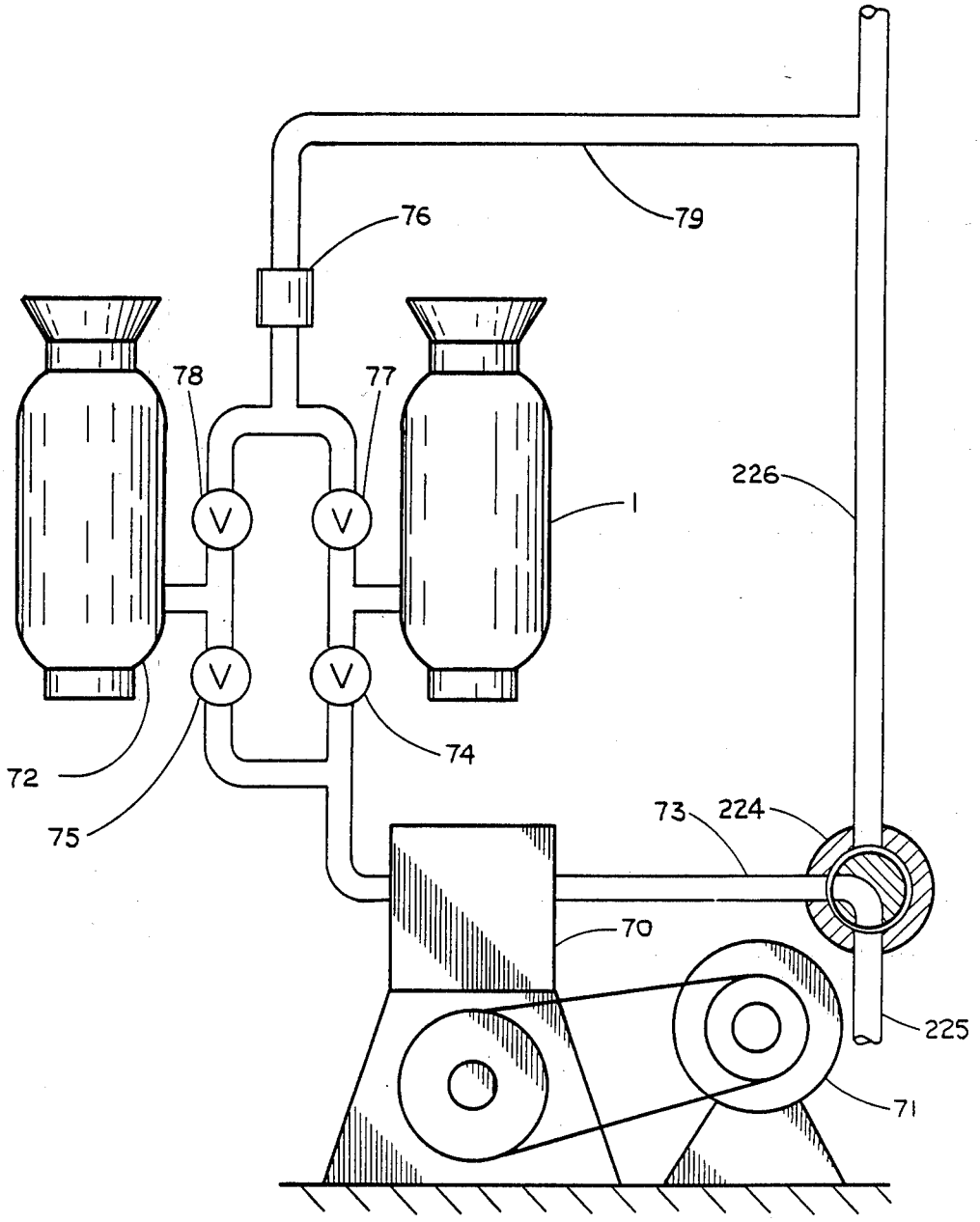

A product gas recirculation means for stopping a cyclic char gasifier plant is shown in FIG. 15.

Figure 16:
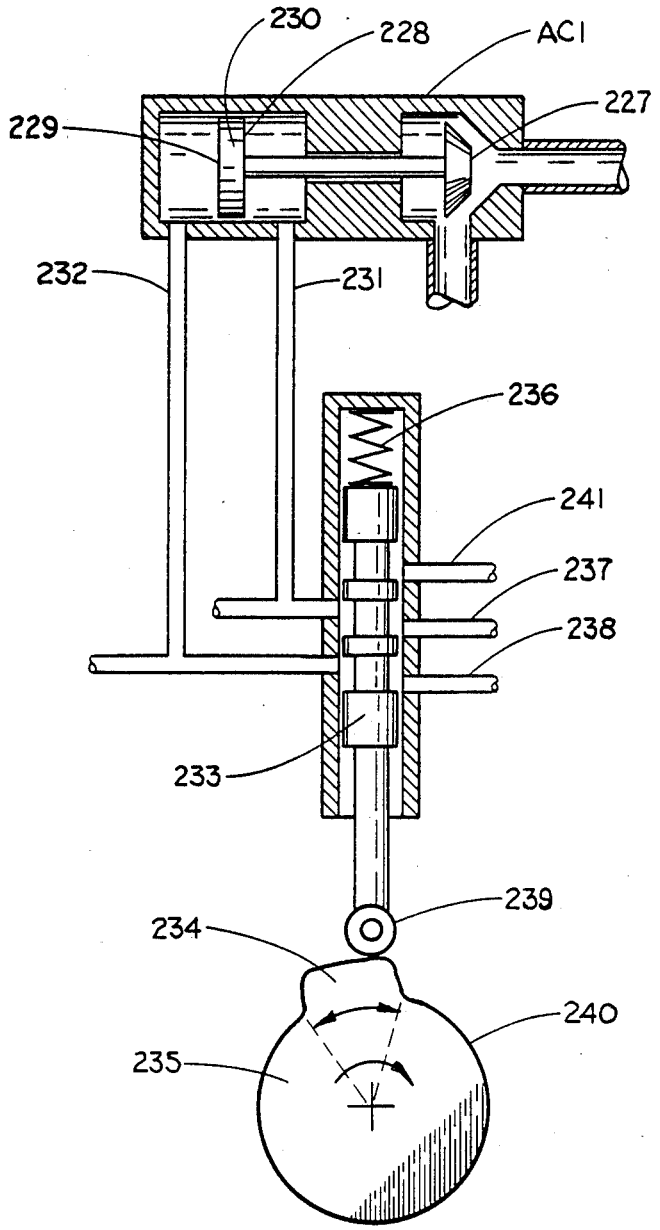
Figure 17:
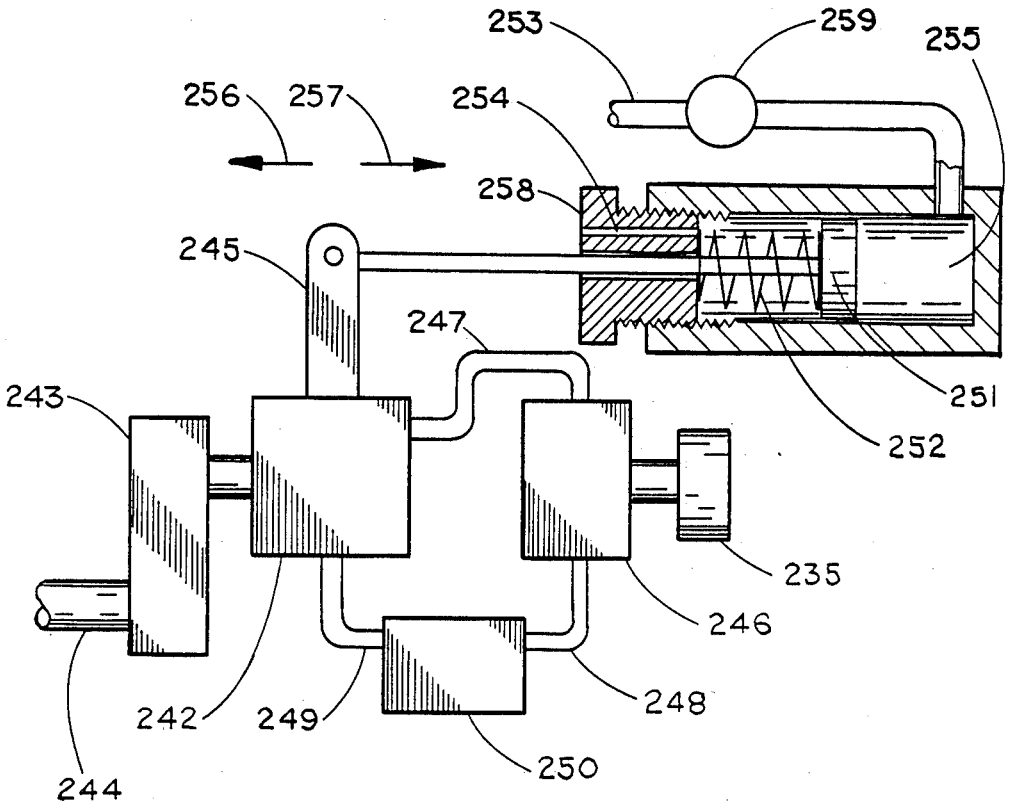

Portions of a pneumatically driven cycle time interval control scheme are shown in FIG. 16, with a hydraulic time interval adjustment means therefor in FIG. 17.

DESCRIPTION OF THE PREFERRED EMBODIMENTS

The processes of this invention utilize the same chemical reactions for char gasification as does the prior art but differ from the prior art in carrying out gasification under different physical conditions and utilizing different apparatus. The beneficial objects made available by this invention result from these differences of apparatus and of physical conditions of reaction.

Basic Processes

The processes of this invention comprise a cycle of compressing reactant gases into the pores of the char fuel where reaction occurs, followed by expansion of the reacted gases out of the char pores. These process steps are repeated through many cycles with fresh reactant gas being supplied and reacted gases being removed for each cycle. It is because the reactant gas is compressed in this cyclic manner that it is forced into the interior pore spaces of the char fuel, the extent of pore penetration by reactant gases increasing as the pressure ratio of compression is increased. Within the char pores the reactant gases are in close contact with a very large area of char and hence reaction occurs rapidly and under strongly reducing conditions since the pore walls are carbonaceous. The reacted gases are then removed from the char pores by expanding these reacted gases in order to make way for the fresh reactant gases of the next cycle.

Compression of the reactant gases requires work input from a drive motor whereas expansion of reacted gases can do work upon an expander engine. In the preferred forms of this invention, this work of expansion is carried out and utilized in part to drive the compressor. Where the overall char gasification reactions are exothermic, this work of expansion of the reacted gases can exceed the work of compression of the reactant gases and a net useful work output can result. This is one of the beneficial objects of this invention, to utilize a portion of the heat of reaction of char gasification, to produce useful work output and this object can be achieved by carrying out a cycle of compression, reaction and expansion as is done in this invention. The available work output increases as the pressure ratio of compression, PCR, increases. We define this pressure ratio of compression, PCR, as the ratio of maximum cycle pressure, PM, to minimum cycle pressure, PO.

Oxidation Gasification Processes

Where air alone is the reactant gas, the char is oxidized largely to CO and the reacted gases are similar to producer gas and are of low volumetric heating value (circa 110 Btu per cu. ft.). Furthermore, these reacted gases from air emerge from the char pores at such high temperatures (circa 3000 degrees Rankine) that very special and costly materials will be necessary for the high temperature inlet portions of any expander engine used. Preferably, air and steam are used together as the reactant gases since the reacted gases resulting are of higher volumetric heating value and emerge from the char pores at temperatures which permit use of reasonable materials for the inlet of the expander engine. These benefits of steam usage can be expressed in terms of the mol ratio of steam to oxygen in the reactant gases, a, which equals the mass ratio of steam to air multiplied by 7.67 when no oxygen enrichment is used. The overall chemical reaction can be then represented by the following reaction balance:

$$(2+a)C+O_2+aH_2O+3.76N_2 \rightarrow (2+a)\text{-}CO+aH_2+3.76N_2+[QCO-a(QH)]$$

The following table 1 presents estimated values of reacted gas heating value, maximum expander inlet temperature and ideal net work output at several values of a as an example of these effects of steam to oxygen ratio. These estimates are based on the assumptions of essentially complete reaction of oxygen and steam, cycle pressure ratio of compression, PCR, of 34 to 1, and negligible heat transfer or other losses.

TABLE 1

| a | Reacted Gas Higher Heating Value, Btu/cu. ft. at STP | Maximum Expander Inlet Temp., °R. | Ideal Net Work, Btu/lb. mol $O_2$ |
|---|---|---|---|
| 0 | 109 | 3258 | 44777 |
| 0.2 | 123 | 2883 | 41365 |
| 0.4 | 135 | 2550 | 37562 |
| 0.6 | 145 | 2250 | 33242 |
| 0.8 | 154 | 1978 | 28637 |
| 1.0 | 162 | 1729 | 24077 |
| 1.2 | 170 | 1498 | 19503 |
| 1.5 | 180 | 1183 | — |

Steam has been used in this way in the past to improve producer gas richness but these benefits have been partially offset by occurrence of the Neumann reversion reaction in prior art processes. In the presence of steam and the absence of carbon, carbon monoxide and steam can react to form diluent carbon dioxide and hydrogen and this reduces the gas richness. In the preferred processes of this invention, a steam-free gas, usually a portion of the reacted gas, is used for the final portion of each compression in order to force steam inside the char pores. Within the strongly reducing pores any carbon dioxide formed is promptly reduced to carbon monoxide by adjacent hot carbon and steam is reacted essentially completely. In this way, the Neumann reversion reaction can be largely suppressed since steam and carbon monoxide co-exist only within the strongly reducing char pore spaces.

Further benefits can be obtained by using a changing value of the steam oxygen ratio, a, during each compression. Preferably, the steam oxygen ratio is increased as each compression with oxygen-rich gas proceeds with the result that the reacted gases first expanded out of the char pores can be richer than those reacted gases expanded later out of the char pores. These reacted gases of differing richness can be kept separate by use of separate expanders and in this way two or more final product reacted gases can be produced differing in richness of which the first gas can have volumetric heating values in excess of about 200 Btu per cu. ft. at STP. Inevitably, as a richer first expanded gas is produced in this way, necessarily leaner later expanded gases result. Although a decrease of steam oxygen ratio as compression proceeds could also be used, the above described increase is preferred since the temperatures of the first gases expanded can be greatly reduced. It is this first gas expanded which yields maximum expander inlet temperatures when steam oxygen ratio is constant. Thus, by using a variable steam oxygen ratio which increases during the progress of each compression, we gain the added benefit of reduced maximum expander inlet temperatures. Of course, preferably no steam is admitted during that final portion of each compression when all steam is to be forced inside the pores by displacement with a steamfree gas when the Neumann reversion reaction is to be suppressed.

To get these oxidation gasification reactions started, the char must be brought up to its rapid burning temperature. This rapid burning temperature differs somewhat between different chars but almost all char fuels will react rapidly with air at temperatures of about 1000° F. or greater as shown, for example, in reference B, and some char fuels react readily at temperatures as low as 800° F. For startup the char fuel can be heated up to its rapid burning temperature by several different means of which the following are examples:

(i) Cyclic compression and expansion with preheated air or preheated oxygen-rich gas is a preferred starting means. This air preheating can be done in several ways as, for example, with electrical heaters or combustion-fired heaters and preferably after the air has been compressed.

(ii) Cyclic compression and expansion with air on a char fuel soaked with a volatile hydrocarbon which latter can be spark or compression ignited and thus heat up the compressed air and char fuel.

(iii) Where very high pressure ratios are used, the cyclic compression and expansion may alone be sufficient to bring the char fuel up to its rapid burning temperature.

(iv) Electrical or furnace heating schemes can also be utilized.

Combinations of these and other starting means can also be used.

Once started the reaction of the char fuel with oxygen will elevate the char temperature further and burning can thereafter continue without use of the startup means, provided the average reacted gas temperatures are kept sufficiently high. When fresh char fuel is introduced, it will be soon heated up to the rapid reaction temperature by adjacent hot and burning char. As reactant gases enter the char pores during compression, both oxygen and steam react rapidly with adjacent hot carbon and the char fuel and reacted gases tend to reach the same average temperature. Hence, we prefer to keep the average reacted gas temperature above the rapid reaction temperature of the char fuel (circa 1000° F., 1460° Rankine). As steam oxygen ratio, a, is increased the average temperature of the reacted gases decreases since the steam oxidation of carbon is endothermic. If too much steam is used, the average reacted gas temperature, and with it the average char temperature, will drop below the char rapid reaction temperature and the oxidation gasification reaction will die out. Hence, the maximum value of the overall steam oxygen ratio for practical use is set at about that value, yielding an average reacted gas temperature equal to the char fuel rapid burning temperature. For example, an approximate calculation for a cycle pressure ratio of compression of 34 to 1, using unpreheated air with steam as reactant gases, showed that the overall steam oxygen ratio, a, should not exceed about 1.50 if reacted gas average temperatures are to be kept above about 1000° F. Higher values of steam oxygen ratio can be used at higher values of cycle pressure ratio and with preheated reactant gases. Also, higher values of steam oxygen ratio can be used during a portion of the compression, as described hereinabove, provided that lower values are also used during other portions of the compression, in order that the overall steam oxygen ratio does not exceed the allowable value. Where steam oxygen ratio is varied during each compression, the char fuel mass acts as a heat retainer to carry over excess reaction energy from those compression portions using low steam oxygen ratios to those compression portions using high steam oxygen ratios and hence those deficient in reaction energy.

The temperatures of the reacted gases within the char and at expander inlet vary appreciably, not only with pressure changes of compression and expansion, but also as between incremental gas portions which entered the char pores during different portions of the compression process. This latter temperature variation between masses results from the fact that the work of compression per unit mass is greater at higher temperatures. The first reactant gas compressed into the char pores reacts therein and is subsequently compressed to the maximum cycle pressure as a high temperature gas and thus a large amount of work of compression is done upon this first gas mass. The last reactant gas to enter the char pores is first compressed at low temperatures up to the maximum cycle pressure and only then enters the pores and reacts and thus a smaller amount of work of compression is done upon this last gas mass. An approximate calculation of this mass variation of temperature due to compression work differences at a cycle pressure compression ratio of 34 to 1 shows maximum pore gas temperatures to vary from about 3200° Rankine up to about 5800° Rankine when air alone is used as reactant gas. The calculation procedure used is an adaptation of that described in reference C for constant volume combustion cases. This mass distribution of temperature within the char pores, in turn, determines the temperature distribution during expansion when the reacted gases leave the char pore space and enter the expander engine. A particular mass of reacted gas expands within the pores back down to about that same pressure at which it first reacted inside the pores and, the pore volume being again fully occupied, this gas mass leaves the pores and enters the expander. Hence, the mass distribution of expander inlet temperatures is reversed from the mass distribution of maximum pore gas temperatures. The last gas mass to enter the char is the coldest inside the pores but, being the first to leave, is hottest at expander inlet. The first gas mass to enter the char is the hottest inside the pores but, being greatly cooled by expansion while still inside the pores, is coldest at expander inlet. An approximate calculation of these effects, for the above-assumed example case, shows expander inlet temperature varying from about 3200° Rankine to about 2600° Rankine when air alone is used as reactant gas. If a simple blowdown expander is used without recovery of the work of expansion, these very high expander inlet temperatures can perhaps be tolerated by presently available expander materials. When, however, we seek to recover the work of expansion, as is preferable, an expander engine must be used and only a few very expensive materials such as tungsten and platinum can be used for the inlet portions of this engine. Hence, we want to use steam also as a reactant gas, not only to enrich the reacted gases, but also to limit expander inlet temperatures to reasonable values in order to use less costly materials in the expander engine.

Presently available engine materials permit use of a moderate range of values of maximum expander engine inlet temperatures, but in general, as higher maximum expander inlet temperatures are used either more expensive materials are required or the useful life of the engine is reduced. For each selected value of maximum useable expander inlet temperature, a corresponding value of minimum useable overall steam oxygen ratio exists for any one cycle pressure compression ratio and reactant gas temperature. For example, using again the above assumed example case with non-varying steam oxygen ratio, a minimum steam oxygen ratio of about 0.045 is needed to keep maximum expander inlet temperature below 2100° F. (2560° Rankine) and this corresponds roughly to current practice in gas turbine type expander engines.

The useable range of values of the steam oxygen ratio is thus set at maximum by char rapid burning temperatures needed and at minimum by expander inlet temperature capabilities of available materials. Where the steam oxygen ratio remains constant during compression with air, this range of useable a values lies at present roughly between about 1.50 and 0.40 when expander work is to be recovered. Where the steam oxygen ratio increases during compression, a wider range of useable a values becomes available. The overall steam oxygen ratio cannot exceed about 1.50 if the char is to be kept burning but a values well in excess of 1.5 can be used for the later portions of the compression provided correspondingly reduced values are used for the earlier portions. In this way, a separated portion of the reacted gas can be made very rich in heating value per cu. ft. Where the steam oxygen ratio increases during compression, the expander inlet temperatures all become more nearly equal with the result that minimum overall steam oxygen ratios less than about 0.40 can be used with available materials and a higher net work output will be available.

During the operation of a cyclic char gasifier using air and steam as reactant gases, one method of controlling the overall steam oxygen ratio is to sense the maximum expander inlet temperature and use this signal to increase steam flow when temperature rises above a set value and decrease steam flow when temperature drops below a set value. These set values of expander inlet temperature then determine the overall steam oxygen ratio being used and hence the heating values of the reacted gases produced. Alternatively, the overall steam oxygen ratio can be controlled by sensing the ratio of hydrogen to carbon monoxide in the reacted gases and using this signal to increase steam flow when this ratio drops below a set value and to decrease steam flow when this ratio rises above a set value. Sensing devices of these kinds and control schemes of these types are already well known in the art of controls and sensors.

The reacted gases can also be enriched by oxygen enrichment of the air and steam reactants, the principal effect being to reduce the proportion of inert diluent nitrogen in the reacted gases. To avoid excessive expander inlet temperatures, the steam oxygen ratio must also be increased when oxygen enrichment is utilized. In table 2 are shown the results of approximate calculations of the beneficial effects available via oxygen enrichment expressed in terms of the oxygen enrichment factor, W, equal to the fraction of reactant oxygen supplied as pure oxygen.

TABLE 2

| Oxygen Enrichment Factor, W | Required a | Reacted Gas Heating Value, Btu/cu. ft. @ STP |
|---|---|---|
| 0 | 0.8 | 154 |
| .095 | 0.823 | 163 |
| .120 | 0.828 | 166 |
| .203 | 0.85 | 174 |
| .406 | 0.90 | 198 |
| .608 | 0.95 | 229 |
| .811 | 1.00 | 267 |
| 1.00 | 1.047 | 315 |

The above calculated values of required steam oxygen ratio, a, are for maintaining an expander maximum inlet temperature of 1540° F. (2000° Rankine) when using an overall pressure compression ratio of 34 to 1. For the above calculations, both W and a were assumed non-varying during compression.

Pure oxygen can be made in an oxygen plant, by methods already well known in the art of oxygen manufacture, but an appreciable work input to this oxygen plant is necessary. According to reference D, an operating liquid oxygen plant requires about 6000 Btu work input per pound of commercially pure oxygen produced, although ideally only about 1322 Btu work input are needed. Where the only source of work for this oxygen plant is the net work output of the oxidation char gasifier process itself, only rather modest quantities of oxygen will be available for oxygen enrichment. For the above approximate calculated conditions and assuming that about 85 percent of net ideal process work is realizable, an available oxygen enrichment factor, W, of about 0.12 is estimated and this yields a reacted gas enriched by about 7.8 percent. Where additional sources of work input to the oxygen plant are economically available, greater oxygen enrichment can be utilized. For example, where all or a portion of the reacted gas are to be pumped through pipelines to distant markets, it may well prove more efficient to divert a portion of the pipeline pump work into oxygen enrichment, thereby reducing the pump work requirement per unit of heating value delivered to market.

Just as a portion of the reacted gas could be appreciably enriched by use of varying steam oxygen ratios during each compression, so also can further enrichment of these same reacted gas portions be accomplished by varying the oxygen enrichment factor, W, during each compression. Preferably, both the oxygen enrichment factor, W, and the steam oxygen ratio, a, are increased together as a cycle of compression with oxygen containing gases proceeds with the result that the reacted gases first expanded out of the char pores are made richer than those later expanded out both by the extra steam enrichment and by the extra oxygen enrichment. Again, these differently enriched gases are preferably kept separated as for example by use of separate expanders. In these ways, two or more final separated product reacted gases can be created differing in richness of which the first gas can have volumetric heating values approaching 300 Btu per cu. ft. at STP. These processes of this invention which yield two or more product reacted gases of differing richness may be particularly beneficially used in cases where, for example, a portion of the product gas is to be pumped to distant markets, another portion is to be pumped to nearer markets and still other portions can be efficiently utilized adjacent to the cyclic char gasifier plant.

As the char fuel is gasified by these processes, it is used up and must be replaced if previously mined coal or other delivered char fuel is being used or the coal seam is gradually depleted if underground gasification is being used. Where previously mined coal or other delivered char fuel is being used, coke can be produced as an additional output produce by removing the char fuel from this oxidation process before it is completely used up. The proportion of coke as a product can be readily adjusted.

Devolatilization Gasification Processes

The same basic processes can also be used for the devolatilization gasification of char fuels. In principle, any reactant gas can be used for devolatilization but reactant gases of low or near zero oxygen content are preferred as minimizing explosion hazards. Particularly preferred reactant gases for devolatilization processes are one or more of the output reacted gases from an oxidation gasification process, these being near zero in oxygen content and becoming further enriched by the volatile matter gasified from the char fuel by devolatilization. If steam is used in the oxidation gasifier, the reacted gases therefrom will contain hydrogen which, when compressed as reactant gas into the char fuel in the devolatilization gasifier, may hydrogenate portions of this char fuel. For most coals such hydrogenation can produce an increased output of volatile matter as discussed, for example, in reference E, and hence still further enrichment of final output gases can occur.

Where the preferred reacted gases from an oxidation gasifier are to be used in whole or part as the reactant gases for a devolatilization gasifier, it will be preferable to cool these gases to lower temperatures not only to reduce the required work of subsequent compression but also to reduce the size of the devolatilization compressor and the requirement for costly materials to be used therein. On the other hand, rather high temperatures (circa 1200° to 2200° Rankine) are preferred for the compressed reactant gases within the devolatilization gasifier in order that devolatilization will occur rapidly and reasonably completely. These seemingly opposed preferences can be fulfilled by cooling the reactant gas prior to compression and heating the reactant gas following compression. By using a post compression heater in this way together with an expander engine, the devolatilization process can produce a net work output over and above that needed to drive the devolatilization compressor and this is an additional beneficial object of this preferred devolatilization process using precompression coolers and post compression heaters.

Various heat sources can be used for the post compression heater such as a coal-fired furnace, a lean gas-fired furnace, or preferably one or more of the output reacted gases from an oxidation gasifier.

For some kinds of char fuels a greater removal of evaporatable materials during devolatilization can be achieved by reducing the pressure on the char fuel to a high vacuum. Vacuum pumps can be used for this purpose of further reducing the container pressure after expansion of reacted gases is complete to final pressure. It is then preferable to utilize a vacuum expander engine to carry out the first portion of the next following compression in order to recover the work available from this expansion from reactant gas supply pressure down to the vacuum pressure on the char fuel being compressed. Some portions of the evaporable materials additionally removed from the char fuel by such use of vacuum can be subsequently recovered as liquids by cooling the reacted gases after they leave the devolatilization process.

After devolatilization the remaining involatile portions of the char fuel are removed from the devolatilization process and are available for use elsewhere as a product char fuel. Preferably all or a portion of this devolatilized char fuel is used as char fuel supplied to any associated oxidation gasification processes. Portions of this devolatilized char fuel can also be sold as a final output product in those areas where such fuels find a market and the size of this marketed portion is easily adjusted.

Mined coal or other char fuel deliverable to the devolatilization gasificatiun process will most commonly be used so that the devolatilized char fuel can be recovered as an output product. In some cases, it may be preferred to devolatilize a coal within its original geological formation or seam. In this case, compression and expansion can be carried on via a borehole providing access to the coal seam. The volatile matter portions of the coal can be recovered in this way but the devolatilized char can only be recovered by subsequent in-place oxidation gasification or by mining.

Combination Processes

The processes of this invention make possible the efficient matching of available char fuel resources to market energy needs and this is one of the beneficial objects of this invention. For these purposes the processes of this invention can be used singly or in combination. For example, where a low-cost plant is desired and the gas fuel produced is used nearby, an oxidation gasifier process used alone may be preferred. In cases where the gas fuel product is to be piped to distant markets, a rich gas will be desired and this can be secured by using bituminous coal in a devolatilization gasifier process together with an oxidation gasifier process, the devolatilier char output being used in whole or part as input char fuel to the oxidation gasifier, the oxidation gasifier gas fuel products being used in whole or part as the reactant gases for the devolatilization process and being enriched thereby. These combination processes, wherein devolatilization gasification processes are combined with oxidation gasification processes, are seen to be capable of producing the following fuel and energy products: one or more gaseous fuels of which one or a few may be enriched; a devolatilized char fuel product; a coke fuel product; electric power. Additionally, the relative proportions of these products can be varied over a wide range to match market demands. These several products can be created from coals, municipal garbage, wood wastes, agricultural wastes, oil shale and many other fuels used alone or in combination.

The adjustability of product output is illustrated in the following table of calculated approximate values of energy output for a devolatilization gasifier process in combination with an oxidation gasifier process operating at an overall pressure compression ratio of 34 to 1, expressed in Btu per pound mol of oxygen.

TABLE 3

| Steam Oxygen Ratio, a | Coal Input (3) | Gas Output | Work Output (1) | Gas Heating Value (2) |
|---|---|---|---|---|
| 0.4 | 569222 | 377352 | 31928 | 147 |
| 0.6 | 616658 | 428673 | 28256 | 157 |
| 0.8 | 665093 | 479796 | 24341 | 167 |
| 1.0 | 711528 | 531063 | 20465 | 175 |
| 1.2 | 758963 | 582637 | 16578 | 182 |

(1) Calculated as 85 percent of ideal work
(2) In Btu per cu. ft. at STP
(3) Assuming an "average" bituminous coal Note that the relative proportion of gas fuel energy output to work output can be varied by a factor of threefold by adjustment of the steam oxygen ratio of the oxidation gasifier process. The proportions of char fuel product output and coke product output can be varied over a wide range by varying the time duration of the processing. For example, the yield of coke product can be increased by shortening the time duration of oxidation gasification processing to which an input char fuel is subjected, the char fuel input rate being correspondingly increased.

The gases evolved during devolatilization from bituminous coals have a volumetric heating value of the order of 550 to 560 Btu per cu. ft. at STP and, in a combination process, these gases can enrichen the reacted gas output of the oxidation gasifier process. The enrichening available in this way can be expressed in terms of the char utilization ratio, b, defined as the mass ratio of char fuel consumed in the oxidation gasification process to char fuel created as output of the devolatilization gasification process. The following table shows approximate calculated values of enrichening available from use of combination processes in this manner under conditions similar to those assumed for table 3.

TABLE 4

| Char Utilization ratio, b | Final Produce Gas Heating Value in Btu per cu. ft. at STP | | |
|---|---|---|---|
| | a = 0.4 | a = 0.8 | a = 1.2 |
| 1.0 | 147 | 167 | 182 |
| 0.5 | 159 | 178 | 194 |
| 0.1 | 233 | 251 | 265 |

Note that very appreciable enrichment by the coal volatile matter can be achieved when the char output of the devolitization gasifier is greater than the char input to the oxidation gasifier (i.e., at low values of b) as could be the case when an appreciable market exists for devolatilized char fuel.

The foregoing calculated results shown in Tables 3 and 4 are for an oxidation gasifier process using a non-varying steam oxygen ratio during compression and a single expander engine. When, however, the steam oxygen ratio is increased during each compression and the reacted gases are separated as for example by use of two or more separate flow expander engines even greater enrichment of a portion of the reacted gases can be achieved.

The one or more final reacted product gases may additionally be processed further, by methods already well known in the art of coal gasification, for removal of undesirable materials, such as sulfur containing gases, and for recovery of valuable chemicals, such as liquid fuel materials and ammonia. Removal of sulfur containing materials may also be aided by addition of basic materials, such as limestone, to the char fuel being supplied to an oxidation gasification process.

Basic apparatus

The basic apparatus of this invention is the same for both devolitilization gasifier plants and oxidation gasifier plants. The basic apparatus comprises combinations of a reactant gas compressor and drive means therefor, reacted gas expanders, two or more containing means or connections to containing means for containing compressed gases, means for connecting a containing means first to the compressor and then to the expander so that the aforedescribed basic process cycle of compression with reactant gas followed by expansion of reacted gas is carried out in a series of such cycles. Many different kinds of compressors, drive means, expanders, containers and connecting means can be used and it is this particular combination of these elements which constitute the basic apparatus of this invention. Additional elements may also be used together with this basic apparatus. For example, although the expander can be a simple blowdown pipe, it is usually preferable to recover the work of expansion by use of an expander engine, such as a piston engine or a turbine, together with a work absorbing element, such as an electric generator. When an expander engine is used in this preferred way in an oxidation gasifier, it will also be usually preferable to add on a steam boiler element or other steam source so that steam can be used as one of the oxidizing agents to enrichen the reacted gases and to reduce the inlet gas temperatures to this expander engine to reasonable values.

Two different types of containing means can be used: sealed pressure vessels with suitable gas flow connecting pipes, refuel means, and coke removal means; underground coal seams contained in the surrounding geological rock formation or other external formations and provided with a borehole and connections for gas flow into and out of the coal seam. For the underground or other external containing means, the connections to the borehole may be the appropriate element of this invention in lieu of the containing means as such. For the sealed pressure vessel containing means, the char fuel needs to be delivered thereto in the form of already mined coal, or as wood waste, etc. A particular benefit of using an underground coal formation as a containing means is that the cost of mining the coal is avoided. Only those coal seam formations which are reasonably tightly sealed against gas leakage by the surrounding geological formation are useable as containing means for this invention since in a very loose formation too much of both the reactant gases and the reacted gases would leak out and be lost. Of course, it is just these tightly sealed coal seams which are the most costly to mine and also the most difficult to gasify underground by prior art methods which require a flow of gases through the coal seam from one borehole to another. This is one of the beneficial objects of this invention that it provides an efficient method for underground gasification of those coal seams which are otherwise difficult and costly to use.

Various details of the elements of the basic apparatus and also additional elements useable for special cases are now described hereinbelow.

Apparatus Details

Any of the several different kinds of compressors, such as piston compressors, roots blowers, centrifugal compressors, axial flow compressors, etc., can be used alone or in combination as the reactant gas compressor. Multistage compressors may be preferred in cases where a high cycle pressure compression ratio is used in order to obtain high work output. The particular definition of a stage of a compressor or an expander is used herein and in the claims to be a portion of said compressor or expander which has a gas flow inlet and a gas flow outlet, both of which make connections external from the compressor or expander. For example, a single stage thusly defined could contain several piston and cylinder units acting to compress gas in series provided that all gas flow between such units went exclusively between units and not externally. When two or more compressor stages are connected in series with the delivery of a first stage connected to the supply of a second stage, whose delivery may, in turn, be connected to the supply of a third stage, the pressure at delivery necessarily rises from first stage to second stage to third stage and so on since each succeeding compressor stage receives at supply gas already raised to a higher pressure by the preceding stage. Hence, such later compressor stages connected in series are commonly and herein referred to as higher pressure stages. Compressor stages or groups of stages not thusly connected together in series are herein referred to as separate compressors. Multistage compressors will usually be preferred for large char gasifier plants and particularly when using turbo compressors in whole or part so that a high compressor efficiency can be achieved by operating each stage over only that narrow range of pressures for which it was optimally designed. For oxidation gasifiers, using air, the compressor should have a flow rate capacity, M in pounds per hour, at least equal to that given by the following approximate formula:

$$M = (VPM)\frac{.364}{(5.76 + 2a)}$$

Where VPM is the intended gasifier output product gas maximum flow rate in cu. ft. per hour at standard temperature and pressure. For multistage compressors only the first, lowest pressure stage need have this ful capacity since the needed capacity of later stages is less than this by the flow rate of gas into containers connected to earlier stages.

Where the final compression is to be with inert gas in order to suppress the Neumann reversion reaction, the following approximate relation can be used to determine the minimum capacity of the inert gas compressor, MI, in lbs. of inert gas compressed per hour.

$$(MI) = (M)\frac{(fD)}{(1 - fD)}\ \frac{(5.376 + a)}{(4.6)}$$

Wherein fD is the fractional dead volume of the container gas space volume not filled with char fuel. This relation assumes that the inert gas is the preferred expanded reacted gas.

Any suitable drive means can be used to drive the compressor such as electric motors, steam turbines, or preferably the expander engine of the char gasifier plant itself. Either constant speed drive or variable speed drive of the compressor can be used. For large char gasifier plants using turbo compressors in whole or part and particularly when driven by turbine expander engines of the gasifier plant itself, a nearly constant speed of these turbo units will usually be preferred so that best efficiency blade speeds can be used and also so that constant frequency electric power can be generated.

Any of the several different kinds of expander engines, such as piston engines, radial flow turbines, axial flow turbines, etc., can be used alone or in combination as the reacted gas expander engine. A simple blowdown pipe can alternatively be used as a low-cost, non-engine expander but the available work of expansion is then lost so this type of expander is probably practical only when other work sources for driving the compressor are readily available and cheap. Multistage expanders may be preferred where a high cycle compression ratio is used to obtain high work output and so that high expander efficiency can be obtained by operating each stage over only that narrow range of pressures for which it was optimally designed. When two or more expander stages are connected in series, with the discharge of a first stage connected to the inlet of a second stage whose discharge may, in turn, be connected to the inlet of a third stage. the pressure at inlet necessarily decreases from first stage to second stage to third stage and so on since each succeeding expander stage receives at inlet gas already expanded to a lower pressure by the preceding stage. Hence, such later expander stages connected in series are commonly and herein referred to as lower pressure expander stages. Expander stages or groups of stages not thusly connected together in series are herein referred to as separate expanders. For oxidation gasifiers the expander should have a flow rate capacity, MX in pounds per hour, at least equal to that given by the following approximate formula:

$$MX = \frac{(VPM)\,(5.376 + a)}{(25.27)\,(2.88 + a)}$$

For multistage expanders only the last, lowest pressure stage need have this full capacity since the needed capacity of earlier stages is less than this by the flow rate of gas out of containers connected to later stages. The work output of the expander engine can be absorbed in one or a combination of ways, as, for driving the reactant gas compressor, for driving an oxygen enrichment plant, or for driving an electric generator. The flow rate of reacted gases to the expander is set by the rate at which reactant gases are delivered into the char fuel pores by the compressor, and also by the boiler and oxygen enrichment plant if used, and by the kind of gasification reactions taking place with the char fuel. The expander must pass this reacted gas flow rate so that the reacted gases are fully expanded out of the char pore space down to the minimum cycle pressure in time to make way for the fresh reactant gases of the next following cycle of compression. This desired control of expander flow rate of reacted gases can be accomplished in one or a combination of several ways as, for example, by throttling the reacted gas pressure, by controlling nozzle flow area for blowdown expanders and for turbine expanders, by controlling cut-off timing for piston expanders. Throttling control, while mechanically simple, reduces the work output available from an expander engine. Various means of controlling nozzle flow area are already well known in the art of steam and gas turbines. Various means of controlling the timing of cut-off of flow of high pressure gas into the cylinder of a piston expander engine are already well known in the art of piston steam engines. One scheme for assuring that the desired minimum cycle pressures will be achieved within the cycle time interval is to actuate the reacted gas flow rate controller of the expander in response to the minimum cycle pressure actually reached within the containing means, expander flow rate being increased when minimum cycle pressure increases and being decreased when minimum cycle pressure decreases. This same scheme of control can also be applied to the particular case where multistage expansion is used, and each such stage is connected to a separate containing means, and each containing means is connected, in turn, to each expander stage as expansion proceeds as will be further described hereinbelow. For this particular case, the reacted gas flow rate controller of each expander stage can be actuated as described above by the minimum pressure reached within the connected containing means just prior to when that containing means is to be next connected to the next following expander stage. The expander must be designed to possess a maximum reacted gas flow capacity at least equal to the maximum flow rate available from the containing means and char gasification process being used when operating with the desired minimum cycle pressure.

Where the reactant gas compressor is separately driven as by an electric motor, the expander engine will start up and run as soon as high pressure reacted gas is admitted into the expander. Where the reactant gas compressor is driven only by an expander engine, startup can be accomplished in various ways as, for example, by spinning up the connected compressor and expander by an electric motor, or preferably by admitting high pressure steam to the expander engine inlet.

Sealed pressure vessels as containing means can be lined with ceramic or other high-temperature material when used for oxidation gasifiers where temperatures are high. For devolatilization gasifiers, it may be desirable to taper the container, with area increasing somewhat in the direction of char fuel motion, in order to accommodate free swelling coals without excess sideways pressure. Where underground coal formations are the containing means, boreholes can be used for access thereto and are preferably a single borehole for each separate container fitted with a double pipe, one inside the other, to minimize mixing of reactant and reacted gases. As gasification proceeds in an underground coal seam container, the gas space volume therein increases and as a result the time required for the compression cycle to reach maximum cycle pressure becomes longer. When the time required for full compression becomes excessive, a new borehole can be drilled into the coal seam and the compressor and expander reconnected thereto. On the other hand. the cycle time for a sealed pressure vessel container will not change appreciably when kept full of char fuel. For this cycle time reason, it will be difficult to use both sealed pressure vessel containers and underground coal formation containers together in a single gasifier plant, although it is possible.

An example of a double pipe borehole means for connecting into an underground coal seam container is shown in FIG. 6 and comprises an exit pipe, 126, contained within an entry pipe, 127, and these pipes connecting into the coal seam, 128. The exit pipe, 126, is fitted with a number of changeable gas flow connections, 129, equal to the number of expander stages, and the entry pipe, 127, is similarly fitted with a number of changeable gas flow connections, 130, equal to the number of compressor stages. The total number of such boreholes in use must at least equal the sum of the number of compressor stages plus the number of expander stages in order that each such stage always has a connection into a separate coal seam container. One scheme for starting the char gasificaion oxidation reaction is also shown in FIG. 6 and comprises a combustible fuel gas supply pipe, 131, and starting valve, 132, which directs this fuel gas into the outlet, 134, of the entry pipe, 127. The high voltage wire, 133, creates a spark at the entry pipe outlet, 134, so that this fuel gas burns upon mixing with the compressed air delivered via the valves, 130, and entry pipe, 127, into the coal seam, 128, and in this way the char fuel temperature can be increased up to its rapid reaction temperature. Once the char fuel oxidation reactions within the coal seam become self sustaining, the starting valve, 132, is closed and the high voltage supply is turned off.

Each underground container of char fuel must be separate from the other containers of the plant so that different pressures can be used in these separate containers. This separateness of the individual containers can be obtained by using separate coal seams for each separate container. Alternatively, if all or some of the containers for a plant are to be in a single coal seam, these containers can then be spaced sufficiently apart that the coal seam itself constitutes an adequate seal against gas leakage between containers. The total number of separate containers for a plant must at least equal the sum of the number of compressor stages plus the number of expander stages in order that each such stage always has a connection into a container. The connectings which the containers make to compressor discharges and to expander inlets change and such connectings are herein and in the claims referred to as changeable gas flow connectings. Other gas flow connectings, as between stages of a compressor or an expander, are fixed and remain open whenever the plant is operating and these are herein and in the claims referred to as fixed open gas flow connections. Changeable gas flow connections can be opened and closed while the plant is operating.

Figure 1:
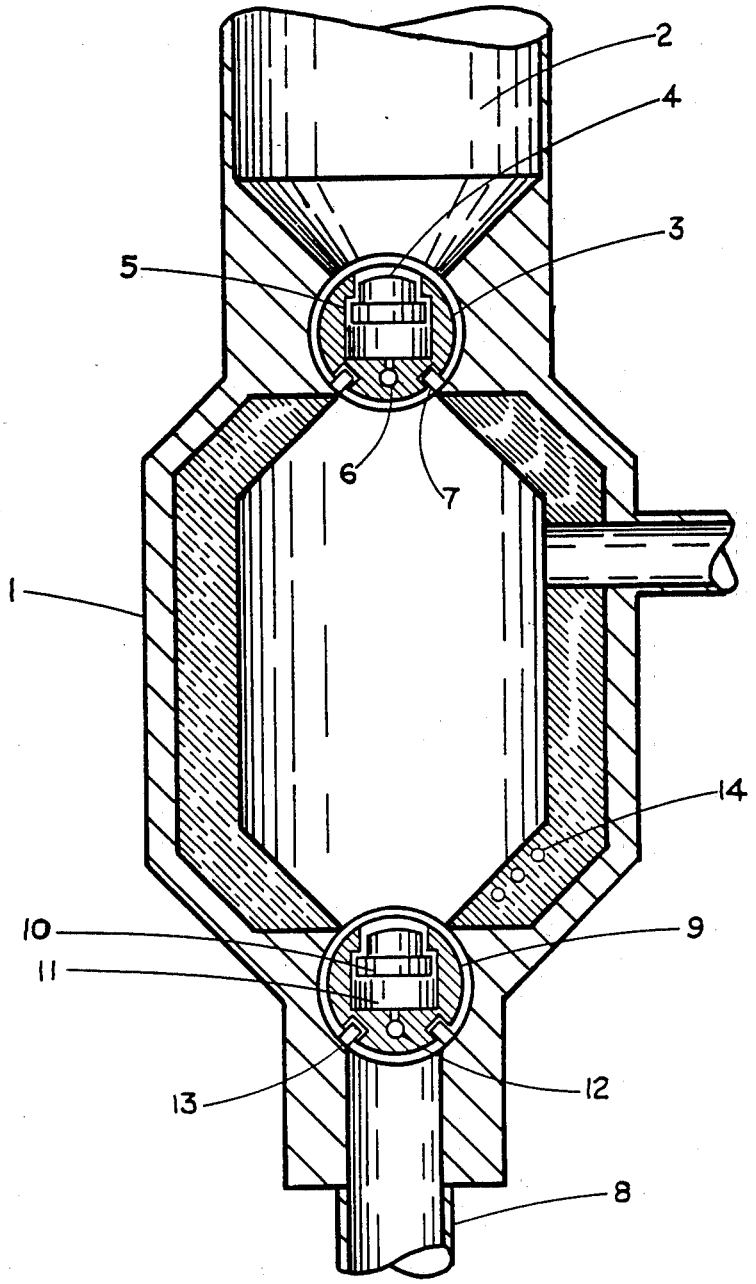

A refuel mechanism is needed for sealed pressure vessel containers as a means for adding fresh char fuel into the container to replace that gasified and to replace that withdrawn as a product output. A wide variety of devices can be used as this refuel mechanism and several of these are described in the cross-referenced related application. An example of a pneumatically actuated refuel mechanism is shown in FIG. 1 as mounted on the top of a sealed pressure vessel container, 1, and connecting a fresh char fuel supply hopper, 2, to said container. This example pneumatic refuel mechanism comprises a refuel valve, 3, a refuel piston, 4, working in a refuel cylinder, 5, within the refuel valve body, a pneumatic pressure supply hole, 6, and pressure sealing means, 7.

Not shown in FIG. 1 are, a means for rotating the refuel valve body, 3, Not shown in FIG. 1 are, a means for rotating the refuel valve body, 3, through an arc of 180 degrees about a horizontal axis, as by hand or automatically via a pneumatically actuated crank, and a control valve to control admission and release of high pressure pneumatic gas via the pressure supply hole, 6, to the refuel cylinder, 5, where the gas pressure can act on the refuel piston, 4. As shown in FIG. 1, the refuel valve, 3, has positioned the refuel piston, 4, in contact with the supply hopper, 2, so that, by release of pressure from the refuel cylinder, 5, a charge of fresh char fuel will enter the refuel valve under the action of the weight of the loose char fuel in the supply hopper. When refueling is to take place, the refuel valve, 3, is rotated through a 180 degree arc to position the refuel piston in contact with the interior of the container, 1, and refueling is accomplished by application of pneumatic pressure to the refuel piston, 4, via the pressure supply hole, 6, from the control valve, this pressure then causing the refuel piston, 4, to force all or a portion of the fresh char fuel into the container, 1. When refueling is completed, the refuel valve, 3, is rotated through a 180 degree arc to return it to the position shown in FIG. 1 where the pressure sealing means, 7, seals the refuel end of the container, 1, against gas leakage. Preferably, the above-described refueling process is carried out when the container is at minimum cycle pressure in order to minimize gas leakage from the container and, with this preferred refuel timing, compressed reactant gas or reacted gas can be used as the source of high pressure pneumatic gas for actuation of the refuel mechanism. Alternatively, other sources of high-pressure gas can be used for actuation or hydraulic actuation can be used also. The refuel mechanism shown in FIG. 1 can refuel with a char volume up to the maximum displacement of the refuel piston, 4, in the refuel cylinder, 5. or with any lesser quantity which refills the container, 1, at the time of refueling. This maximum displacement of each refuel mechanism is preferably at least equal to the maximum required char refuel volume. This maximum required char refuel volume can be estimated by the following approximate equations for oxidation gasifiers using a non-varying steam oxygen ratio:

$$(VF) = \frac{(mmch)(tf)}{(dch)}$$

Wherein (VF) is the refuel volume of each refuel mechanism, mmch is the required maximum char mass flow rate into all active containers, tf is the time interval between refuelings of all containers, and dch is the char fuel density, all in consistent units.

$$mmch = (VPM)\frac{(.174 + .0869a)\,(36.42)}{(5.76 + 2a)(1 - CR)(\%\ C)}$$

Wherein (CR) is the desired coke ratio equal to the mass ratio of coke removed from containers as an output product to char fuel actually placed into these same containers, (%C) is the percent carbon content of the char fuel, and mmch is in units of lbs. per hour. For a devolatilization gasifier, the maximum required char refuel volume can be estimated by the following equations:

$$(VF) = \frac{(mmch)(tf)}{(dch)}$$

$$mmch = \frac{(mmchr)}{(FCD)}$$

Wherein (mmchr) is the required maximum char product mass flow rate out of all active containers and (FCD) is the ratio of char product produced to char fuel put into the devolatilizer. The term (FCD) is similar to the so-called "fixed carbon" content of the char being refueled, but as determined under the conditions actually prevailing in the devolatilization gasifier.

While the time interval between refuelings, tf, can in principle have almost any value, it is usually preferable to refuel each container when it is at minimum cycle pressure at the end of an expansion and before starting the next compression in order to minimize leakage of reactant and reacted gases. Hence, we prefer to refuel each container at most once for each cycle of compression followed by expansion and for this case the refuel time interval, tf, is determined by the cycle time interval, tc, for carrying out one full cycle of compression and expansion on one container, and the number of active containers, na, equal to the sum of the number of containers being compressed, nc, plus the number of containers being expanded, nx.

$$tf = \frac{(tc)}{(nc + nx)}\,(Z)$$

Wherein the refuel ratio Z is any positive integer. The total number of containers, nt, will usually exceed the number of active containers, na, by at least one so that the inactive containers can be refueled, and have coke removed, if desired, in a leisurely manner and at low pressures of the containers, before being returned again to an active cycle of compression followed by expansion. Of course, for an oxidation gasifier, refueling and coke removal cannot be too leisurely or the char fuel within a container will cool down below its rapid reaction temperature. For any one container the time interval between refuelings, tfl, for this case with extra, inactive containers, is then the product of the total number of containers, nt, and the time interval between refuelings, tf.

Various methods of controlling the initiation of refueling can be used. For example, the disconnecting of a container from the last stage of the expander could initiate the refuel mechanism to carry out one refueling operation, and in this case the integer, Z, would be one. Where values of Z other than one are to be used, a mechanical or electrical counter can count up the number of compression and expansion cycles each container experiences. When the set number of cycles, which equals Z, is reached the counter then initiates the refuel mechanism when the container disconnects from the last stage of the expander, and resets itself to start counting cycles again. The set number of cycles, and hence Z, can be made adjustable in integral steps and provides a means for adjusting the maximum char refueling rate available. Other methods of initiating the refuel mechanism can also be used.

One example means for connecting the refuel mechanism is shown in FIG. 7 and comprises the refuel shaft, 135, which rotates the refuel valve, 3, of FIG. 1, the refuel shaft gear, 136, driven by the refuel lever and gear, 137, which is, in turn, driven by the piston, 138, and cylinder, 139. The arc of motion of the refuel lever, 137, between the stops, 140, 141, and the pitch diameter ratio of the refuel shaft gear, 136, and the lever gear, 137, are selected to assure that the refuel shaft, 135, and hence the refuel valve, 3, are rotated through a half turn when the refuel lever, 137, moves from the stop, 140, to the stop, 141. The moving port, 142, rotates with the refuel gear, 136, and connects via the passage, 143, in the shaft, 135, to the driving side of the refuel piston, 4, of FIG. 1, and connects at its other end either to the atmospheric vent, 144, as positioned in FIG. 7, or to the high pressure driving gas supply via the passage, 145, when rotated a half turn as when the lever, 137, is against the stop, 141. As shown in FIG. 7 the refuel shaft, 135, and the refuel valve, 3, are in the disconnected position shown in FIG. 1 with char fuel from the hopper, 2, reloading into the refuel valve, 3, and the side, 146, of the piston, 138, is vented to atmosphere via the valve, 147, and the side, 148, of the piston, 138, is connected to the high pressure driving gas via the valve, 147, and the pipe, 149, thus holding the lever, 137, against the stop, 140. To connect the refuel mechanism the refuel solenoid, DRF, is energized via the electrical connection, T2, thus rotating the valve, 147, through a quarter turn against the return spring, 150, and applying high pressure to the side, 146, of the piston, 138, and atmospheric pressure to the side, 148, of the piston, 138, so that the piston, 138, moves the lever, 137, against the stop, 141, thus rotating the refuel valve, 3, into the refueling position and also applying high pressure driving gas via the passage, 145, to the refuel piston, 4, so that fresh char fuel is forced into the container, 1. When the refuel solenoid, DRF, is next deenergized the pressures on the piston, 138, are again reversed and the piston, 138, lever, 137, shaft, 135, are all returned to their position shown in FIG. 7, and a refueling process has been completed. A refueling process may be thusly carried out by hand via the switch, 156, or preferably automatically via the connection, T2, from the cycle time interval controller to be described hereinafter. The hand switch, 156, can be used during startup to fill the container with char fuel by repeatedly carrying out refuel processes.

For devolatilization gasifiers using sealed pressure vessel containers, a coke removal mechanism is needed as a means for removing devolatilized char from the containers and to make space for fresh refuel char in the containers. A coke removal mechanism can also be used with oxidation gasifiers where it is desired to remove partially oxidized char fuel from the containers as a coke product output. Even for those oxidation gasifiers where the input char fuel is to be fully oxidized to gases, a coke removal mechanism will still be needed in most cases with sealed pressure vessel containers as a means for removing the ashes and is then an ash removal mechanism. Whether used for removal of devolatilized char, or partially oxidized char, or fully oxidized ashes, all such mechanisms are herein and in the claims referred to as coke removal mechanisms and constitute a means for removing a volume of solid materials from the containing means. A wide variety of devices can be used as this coke removal mechanism and several of these are described in the cross-referenced related application wherein they are called ash removal mechanisms. An example of a pneumatically actuated coke removal mechanism is shown in FIG. 1 as mounted on the bottom of a sealed pressure vessel container, 1, and connecting the container interior to a coke discharge pipe, 8. This example pneumatic coke removal mechanism comprises a removal valve, 9, a removal piston, 10, working in a removal cylinder, 11, within the removal valve body, a pneumaiic pressure supply hole, 12, and pressure sealing means, 13. Not shown in FIG. 1 are, a means for rotating the removal valve body, 9, through an arc of 180 degrees about a horizontal axis, as by hand or automatically as via a pneumatically actuated crank, and a control valve to control admission and release of high pressure pneumatic gas via the pressure supply hole, 12, to the removal cylinder, 11, where the gas pressure can act to move the removal piston, 10. This example pneumatic coke removal mechanism is similar to the aforedescribed refuel mechanism and the similarly named components function in a similar manner except that the coke removal mechanism removes a volume of material from the container interior whereas the refuel mechanism adds a volume of material to the container interior.

The delivery ratio, DR, defines the relation between refuel mechanism mass delivery capacity and coke removal mechanism product mass removal capacity.

$$(DR) = \left(\frac{VC}{VF}\right)\left(\frac{dchr}{dch}\right)\left(\frac{tf}{tfr}\right)$$

Whereas (VC) is the removal volume of each coke removal mechanism, (dchr) is the density of the removed material and (tfr) is the time interval between coke removals of all containers. Just as for the refueling we also prefer to remove coke only when the containers are at minimum cycle pressure and hence, for this preferred case, the time interval between coke removals is given by the following relation, similarly to that for the corresponding preferred refuel time interval, tf.

$$(tfr) = \left(\frac{tc}{nc + nx}\right) y$$

Wherein the coke removal ratio y is any positive integer. Hence, for this particular case, the time interval ratio is simply the ratio of Z to y. The density ratio, dchr/dch, can vary appreciably, not only with the type of processing being used but also with the type of coal or other char fuel being refueled. The volume ratio, VC/VF, may be fixed by design of the mechanisms to provide a desired value for DR. Even with a fixed volume ratio, the delivery ratio can yet be adjusted by adjustment of the ratio of z to y, but this adjustment can preferably occur only in steps of integral changes of value of Z and/or y. Alternatively or additionally the volume ratio, VC/VF, can be made adjustable, as for example by use of an adjustable stop which limits the stroke of the removal piston, 10, within the removal cylinder, 11, and in this way a fine and continuous adjustment of delivery ratio, DR, can be made available. The delivery ratio, DR, equals the coke ratio, CR, only when both the refuel volume and the coke removal volume are fully emptied at each refueling and coke removing. For the particular example mechanisms shown in FIG. 1, the coke removal volume will be fully emptied upon each coke removing since the coke discharge pipe, 8, is not obstructed, but the refuel volume can be emptied only to that amount needed to refill the container, 1, and fully only when the container is deficient of char by as much as or more than the maximum refuel volume. Hence, for the example shown in FIG. 1, and for the preferred case of refuel and coke removal only at minimum cycle pressure. the coke ratio, CR, will equal or exceed the delivery ratio, DR, and this is a design point for these mechanisms.

For devolatilization gasifiers the coke ratio, CR, is determined largely by the so-called "fixed carbon" content of the fresh char fuel being refueled and the extent to which this fresh char fuel is actually devolatilized while within the container. The extent of devolatilization can be varied by varying the residence time, tr, of the char fuel within the devolatilization container, and by changing the reactant gas temperature, this extent increasing as residence time or temperature are increased. The design factors for residence time, tr, are the total interior volumes of all active containers, VT, the coke removal rate, mchr, and the average density, dchc, and average "fixed carbon" content, FCA, of the char within the containers as given by the following approximate relations:

$$tr = \frac{(VT)(dchc)(FCA)}{(mchr)}$$

Wherein the FCA is the fixed carbon content for the actual conditions of devolatilization and is only approximately the usual fixed carbon as determined by proximate analysis. For the particular case of the FIG. 1 form of coke removal mechanism, the coke removal rate, mchr, equals the maximum coke removal rate, mmchr, since the coke removal volume is always fully emptied.

$$mchr = mmchr = \frac{(VC)(dchr)}{(tfr)} \text{ (for FIG. 1)}$$

Just as for the refuel mechanism, various methods of controlling the initiation and timing of coke removal can be used. As a preferred example case for devolatilization gasifiers, coke removal occurs only when the containers are at minimum cycle pressure and following next after each refueling. In this preferred way, gas leakage is minimized and the force of refueling acts to force coke into filling the coke removal mechanism just before coke removal takes place. For this example case, then, the completion step of the refueling operation can be used to initiate the coke removal operation and hence the integers Z and y are equal. Although different values of Z and y can be used, as for example, by initiating coke removal after a certain number of refuelings, for devolatilization reactors, it is simpler to use Z equal to y since the mass flow of char into the reactor and the mass flow of char out of the reactor are not too greatly different for most char fuels to be used. The coke removal initiator scheme can be similar to the refuel initiator scheme shown in FIG. 7 and described hereinabove. Alternatively, where the values of Z and y are to be equal, the coke removal process and the refuel process can be carried out by a single initiator scheme such as shown in FIG. 7 wherein the lever, 137, drives both the refuel valve, 3, and the coke removal valve, 9, at the same time.

Where free swelling coals or other such char fuels are to be used in a devolatilization gasifier, the consequent char volume increase can be accommodated in several ways. For example, the area of the coke removal piston, 10, can be made equal to and coincident with the exit cross-sectional area of the container, 1. By keeping a pneumatic pressure on the piston, 10, via the pressure supply hole, 12, at least equal to maximum cycle pressure, the coke removal piston can accomodate its position to the swelling of the char fuel within the container. Preferably also the container walls are tapered as described hereinabove, and as is not shown in FIG. 1, when free swelling char fuels are to be used. Other schemes for accommodating free swelling coals can alternatively be used, such as spring loading otherwise moveable ends of the container.

For oxidation gasifiers the coke removal mechanism can function to remove partially oxidized char fuel as an output coke product, if desired, or alternatively can remove ashes when the char fuel input is to be fully oxidized to gaseous products. These coke removal functions for oxidation gasifiers are not fundamentally different from those already described for devolatilization gasifiers and similar mechanisms can be used. Where only ashes are to be removed, however, the mass and volume of ashes to be removed by the coke removal mechanism are much smaller than the mass and volume of char fuel to be refueled by the refuel mechanism. This volume difference could be accommodated by designing the coke removal mechanism of a smaller size than the refuel mechanism, but then a gasifier so equipped would be impractical to utilize subsequently for production of partially oxidized coke product. Where plant flexibility of product output is desired, it is preferable to design the coke removal mechanism of adequate size for production of partially oxidized coke product. When operating this preferred flexible plant with full char oxidation to ashes, the actual coke removal rate can then be reduced to the ash formation rate by reducing the frequency of coke removal relative to the frequency of refueling. For the particular example refuel and coke removal mechanisms shown in FIG. 1 and for preferred coke removal and refuel occurring only at minimum cycle pressure, the aforedescribed decrease of coke removal frequency relative to refuel frequency can be accomplished by increasing the integer, y, relative to the integer, Z. This control of the ratio of y to Z can be done by hand or preferably automatically as ashes accumulate. For example, ash level sensor schemes can be used, as described in the cross-referenced related application, to sense when the ash level is well inside the container from the coke removal mechanism and this sensing signal can then cause a coke removal process to take place just after the next refueling process. In this way, ash removal occurs automatically and in a manner to assure that only fully oxidized ashes are removed. Thermocouple temperature sensors, 14, are shown in FIG. 1 as an example ash level sensor to detect when the ashes have accumulated up to the levels of these thermocouples, and hence are well above the coke removal mechanism, by sensing the drop in char temperature when the adjacent char is no longer reacting because it has been as fully oxidized as possible.

One example of such an ash level sensor and coke removal initiation control scheme is shown in FIG. 8 and comprises a controller, 151, receiving as inputs at, 152, the outputs of the ash level sensor thermocouples, 14, of FIG. 1, and receiving as additional input at, 153, a signal from the cycle time interval controller to be described hereinafter, and sending out at, 154, power to energize the coke removal solenoid, similar to the solenoid, DRF, of FIG. 7. The controller, 151, can be an electronic counter device which counts up the number of coke removal signals from the cycle time interval controller via, 153, and when the count reaches a set value, the controller, 151, initiates a coke removal process and also resets itself to start counting cycle time interval signals again. The set value of counts is adjusted electronically by the ash leve1 sensors input via, 152, so that the set value of counts increases when the ash level is too low inside the container, 1, and decreases when the ash level is too high inside the container, 1. A hand override switch, 155, can be used during shutdown to empty a container of char fuel by repeatedly carrying out coke removal processes. A controller such as that shown in FIG. 8 can also be used for control or adjustment of the refuel ratio, Z, as for example, by removing the ash level sensor inputs and hand adjusting the set value of counts via the knob, 157, and such hand control can also be similarly adopted for adjustment of the coke removal ratio, y, if desired.

Each container can be fitted with a refuel mechanism and a coke removal mechanism, as is shown for example in FIG. 1, or alternatively all containers can be refueled and have coke removed by use of one or a few refuel mechanisms and one or a few coke removal mechanisms which are connected in turn to the containers when refueling and coke removal are to occur. Each container in this case would be fitted with a means for sealing the refuel port and the coke removal port when these were not in use. The step of initiating a refuel or coke removal process for a container or of connecting the container to a refuel or coke removal mechanism for this purpose is herein and in the claims referred to as connecting to a refuel or coke removal mechanism. To distinguish such refuel mechanism connectings and such coke removal mechanism connectings of containers from the connectings which containers also make to compressor discharges and to expander inlets these latter connectings are herein and in the claims referred to as gas flow connectings. Gas flow connectings can be of two types; fixed open gas flow connections which remain open whenever the plant is operating, and changeable gas flow connections which can be opened and closed while the plant is operating.

Of course, where underground coal formations are being used as a container neither a refuel mechanism nor a coke removal mechanism can be nor need be used.

Figure 2:
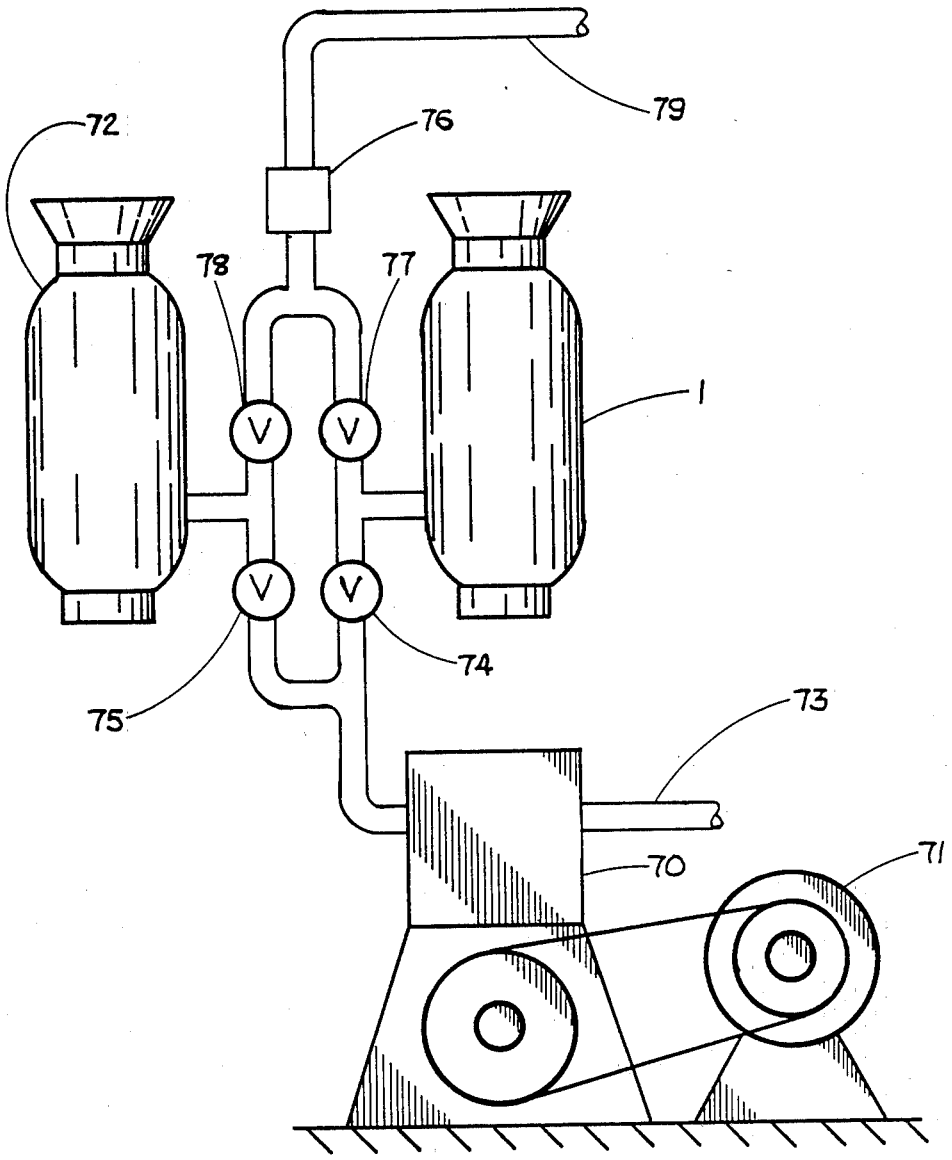

To illustrate how the containers, compressors and expanders are connected and operated together, an example of a very simple oxidation char gasifier plant is shown schematically in FIG. 2 and will be described. This simple plant comprises a compressor, 70, and drive motor, 71, at least two containing means, 1, and, 72, an ambient air inlet pipe, 73, supplying air to the compressor, 70, a blowdown expander, 76, a connection and valve, 74, from the compressor to the container, 1, a similar connection and valve, 75, from the compressor to the container, 72, a connection and valve, 77, from the container, 1, to the expander, 76, and a similar connection and valve, 78, from the container, 72, to the expander, 76, a product gas collector pipe, 79, which collects the plant output gas for delivery to uses. Starting with commencement of compression on container 1, valves 74 and 78 are open and valves 77 and 75 are closed and container 1 is compressed while container 72 expands. When container 1 reaches maximum cycle pressure, the connections are changed to valves 74 and 78 closed and valves 77 and 75 open and container 1 is then expanded while container 72 is compressed. And this sequence of compression followed by expansion is repeated. In this way. the char fuel within the containers experiences a repeated cycle of compression with fresh air followed by expansion of the reacted gases out of the char fuel which is the basic process of this invention. If underground coal seams are the type of containers being used, only the two shown in FIG. 2 are needed. Where sealed pressure vessel containers with refuel and coke removal mechanisms are used, an additional container, not shown in FIG. 2, may preferably be used and be similarly connected so that the processes of refueling and coke removal for each container can occur in a leisurely manner with both container connecting valves closed, but this extra container is not necessary. Control of the duration of compression is most easily accomplished via a pressure sensor on each container which acts via a control scheme to switch the valves, as indicated, wben the container being compressed reaches maximum cycle pressure, and sensors and control schemes of this type are already well known. The expander flow rate is adjusted to assure that each container being expanded reaches minimum cycle pressure within the time interval of the duration of compression and this adjustment of expander flow rate can be done by hand or preferably automatically as by sensing of the minimum cycle pressure or the rate of pressure decrease in the container being expanded and using such sensing signals to control flow area of the expander, 76.

While the char gasifier plant shown in FIG. 2 has the advantage of simplicity, it suffers the disadvantage of requiring a net work input to drive the compressor, 70. This work input disadvantage can be overcome by replacing the low cost blowdown expander, 76, with a more costly expander engine which can render the plant capable of producing a net work output. Unfortunately, for this simple plant using single stage compressors and single stage expander engines, the net work fluctuates very widely, a high net work output obtaining when each container is just starting to be compressed and a high net work input obtaining when each container is about to finish being compressed. If the char gasifier plant is small, these work fluctuations can perhaps be accommodated by the source of work input and absorber of work output such as the local electric power grid. If the char gasifier plant is large, however, these work fluctuations will be difficult to accommodate even within a large electric power grid. Thus, for large char gasifier plants, we prefer not only that the work be always an output but also that this work be reasonably steady and this preferred result can be achieved by use of multistage compressors and multistage expander engines together with several containing means whose number shall be at least equal to the sum of the number of compressor stages plus the number of expander stages. An example of such a multistage oxidation char gasifier plant is shown schematically in FIG. 3 and comprises: a multistage compressor, 20, with low pressure stage, 21, medium pressure stage, 22, and separate inert gas compressor, 23; a multistage expander engine, 24, with high pressure stage, 25, medium pressure stage, 26, and low pressure stage, 27; at least six containing means, 28, 29, 30, 31, 32, 33, with each such containing means being connected at any one time to at most but one stage of the compressor, 20, or the expander engine, 24, via connections and valves, 34, 35, 36, 37, 38, 39, as is shown in FIG. 3; each of the containing means, 28, 29, 30, 31, 32, 33, is fitted with a separate manifo1d, 41, 42, 43, 44, 45, 46, and each such manifold has connections and valves to each stage of the compressor, 20, and to each stage of the expander engine, 24, and these latter connections and valves are not shown in FIG. 3 to avoid undue complexity of this drawing. These pipes and valves constitute changeab1e gas flow connections which can be opened or closed while the plant is operating. The example char gasifier plant of FIG. 3 has a common shaft, 40, for all stages of the compressor, 20, and expander engine, 24, and this shaft connects in turn to the means for absorbing the net work output, 47, such as an electric generator. However, separate shafts and separate work input and/or work output devices can be used for some or all stages of the multistage compressor and the multistage expander engine and such separate shaft arrangements may be preferred where both piston and turbine stages are used together in the compressor and/or the expander engine. Additional connections shown in the example of FIG. 3 are: the ambient air supply pipe, 48, to the intake of the low pressure compressor stage, 21; the intermediate air pressure supply pipe, 49, from the discharge of the low pressure compressor stage, 21, to the intake of the medium pressure compressor stage, 22; the first intermediate reacted gas pressure supply pipe, 50, from the discharge of the high pressure expander stage, 25, to the intake of the medium pressure expander stage, 26; the second intermediate reacted gas pressure supply pipe, 51, from the discharge of the medium pressure expander stage, 26, to the intake of the low pressure expander stage, 27; the product gas collector pipe, 52, which collects the plant output gas discharging from said low pressure expander stage for delivery to uses; the reacted gas transfer pipe, 53, which transfers reacted gas from the discharge of the high pressure expander stage, 25, to the intake of the separate inert gas compressor, 23. These pipes constitute fixed open gas flow connections which remain open whenever the plant is operating. Further, additional connections shown in the example of FIG. 3 are the high pressure steam supply connections, 54, 55, and steamflow control valves, 56, 57, for supply of steam from a high pressure boiler, or other steam source, not shown in FIG. 3, to be added to the air from those compressor stages compressing air in order to supply reactant gases containing steam and oxygen into those containers being compressed with reactant gases high in oxygen content. The connections between each container and manifold to each compressor stage and to each expander stage, and not shown in FIG. 3, are shown in FIG. 4 for but one of the containers, 31, and its manifold, 46. The connections and valves, 39, 58, 59, 60, 61, 62, provide a means for connecting the containers, 31, to each of the expander stages, 25, 26, 27, and to each of the compressor stages, 21, 22, and to the separate compressor, 23, respectively. Each of the containers, 28, 29, 30, 31, 32, 33, and connected manifolds, 41, 42, 43, 46, 45, 44, are similarly equipped with the changeable gas flow connections with valves, shown in FIG. 4 for container 31, to each compressor stage and to each expander stage. The containers, 28, 29, 30, 31, 32, 33, and manifolds, 41, 42, 43, 46, 45, 44, are shown in FIGS. 3 and 4 as separate and connected, but a container and its manifold can be together as a single unit.

In the operation of the example multistage oxidation gasifier plant shown in FIG. 3 and FIG. 4, each container is connected in a sequence of gas flow connectings to the discharge end of each compressor stage and to the inlet end of each expander stage. This sequence of gas flow connectings starts with the lowest pressure stage of the compressor, proceeds, in turn, through each next higher pressure stage of the compressor, and after the highest pressure compressor stage, continues to the separate inert gas compressor, and after the inert gas compressor, continues to the highest pressure stage of the expander and then proceeds, in turn, through each next lower pressure stage of the expander. After a container has proceeded through this full sequence, the sequence can subsequent1y be repeated again and again. When pressure vessel containers are used for each container refueling and coke removal are preferably timed to occur at the end of a sequence sometime between disconnecting from the lowest pressure expander stage and reconnecting to the lowest pressure compressor stage to start the next sequence, when the container is at minimum cycle pressure. The next sequence of gas flow connectings can then commence after refueling and coke removal are completed. For example, in FIG. 4 the foregoing sequence of connectings for container 31 can be carried out as follows: valve 60 is opened and valves 39, 58, 59, 61, 62 are closed and container 31 is connected only to the discharge of the lowest pressure compressor stage, 21; after a time interval valve 60 is closed and concurrently valve 61 is opened and container 31 is then connected only to the discharge of the next higher compressor stage, 22; after the next time interval valve 61 is closed and concurrently valve 62 is opened and coniainer 31 is then connected only to the discharge end of the separate inert gas compressor, 23; after the next time interval valve 62 is closed and concurrently valve 39 is opened and container 31 is then connected only to the inlet end of the highest pressure expander stage, 25; after the next time interval valve 39 is closed and concurrently valve 58 is opened and container 31 is then connected only to the inlet end of the next lower pressure expander stage, 26; after the next time interval valve 58 is closed and concurrently valve 59 is opened and container 31 is then connected only to the inlet end of the lowest pressure expander stage, 27; after the next time interval valve 59 is closed and a sequence of gas flow connectings has been completed; refueling and coke removal preferably take place for container 31 after valve 59 is closed at the end of one sequence of gas flow connectings and before valve 60 is opened to commence the next such sequence or while these valves are being closed and opened. Such refueling need not occur between every pair of sequences for a container, and when refueling is to be less frequent the value of the refuel ratio, Z, is increased so that the number of time periods actually utilized for refueling becomes less than the number of time periods available for refueling. Similarly, coke removal need not occur between every pair of sequences for a container and less frequent coke removal can be achieved by increase of the coke removal ratio, y, so that the number of time periods actually utilized for coke removal becomes less than the number of time periods available for coke removal. Each of the other containers, 28, 29, 30, 32, 33, also has similar connections and valves to each compressor and expander stage and also is similarly connected in sequence to these stages and also is similarly connected in sequence to these stages and to refuel and coke removal in the same manner as described for the one container, 31, except that each container follows out its sequence of connectings in a time order displaced from that of all the other containers so that any one compressor or expander stage is connected to but one container. Of course, where the containers are underground coal seams, refuel and coke removal do not occur and no time intervals are devoted to these operations. So that each stage will always have one container connected, the several active containers change gas flow connectings all at the same time and thus the time interval between changes of gas flow connectings, tcc, is the same as between different containers even though it may differ as between different time intervals in a sequence. The cycle time, tc, is then equal to the product of the time interval between changes of gas flow connectings, tcc, if constant and the sum of the number of containers being compressed, nc, and the number of containers being expanded, nx, which sum also equals the sum of the number of compressor stages and the number of expander stages.

tc=(tcc)(nc+nx)

The cycle time, tc, is basically determined by how longg it takes the compressor to pump up a container from the selected value of minimum cycle pressure, PO, up to the selected value of maximum cycle pressure, PM, and clearly increases with increasing container gas space volume and with decreasing compressor flow rate capacity, M. An approximate analysis of the compression and reaction process within a container provides the following approximate analytical relation for cycle time, tc, for oxidation gasifiers using a non-varying steam oxygen ratio, a:

$$tc = \frac{(VR)(nc + nx)(PO)(PM - PO)(4.76)(MA)(33.5)(CPB)}{(PB-PA)K(RB)(M)(nc)[(QR)+(5.76+2a)(TO)(2)(MB)(CPB)]}$$

Wherein:

(VR)=total gas space volume of all containers being compressed;

(TO)=ambient air intake temperature at inlet to lowest pressure compressor stage;

(M)=compressor air flow capacity in mass per unit time, assumed approximately equally distributed between stages and approximately constant over the range of pressures;

(MA)=average molecular weight of air;

CPB)=specific heat at constant pressure of reacted gases inside pores, energy units per unit mass;

(PB)=high reference pressure, equivalent to 500 pounds per square inch absolute;

(PA)=low reference pressure, equivalent to one atmosphere;

(K)=specific heats ratio of reacted gases inside pores, the isentropic exponent;

(RB)=perfect gas constant of reacted gases inside pores;

(MB)=average molecular weight of reacted gases inside pores;

(QR)=heat of reaction of the air and steam with carbon inside pores, energy units per mol of oxygen reacted; equivalent to (1.74-a)(55273) if in Btu per lb. mol $0_2$ for complete reaction at constant heat of reaction.

This same approximate analysis yields the following approximate analytical relation for maximum expander inlet temperature, TGMA:

$$(TGMA) = (TO)\left(\frac{PM}{PO}\right)^{\frac{K-1}{K}} + \frac{(QR)}{(5.76 + 2a)(MB)(CPB)}$$

More accurate analytical approximations can be made by use of gas tables and other gas properties tabulations. Any consistent system of units may be used in these relations for tc and TGMA. For devolatilization gasifiers, the following approximate cycle time relation is obtained by assuming the net heat of reaction to have only a negligible effect.

$$tc = \left(\frac{VR}{M}\right)\left(\frac{nc + nx}{nc}\right)\frac{(PO)}{R(TO)}\left[\left(\frac{PM}{PO}\right)^{\frac{1}{K}} - 1\right]$$

Wherein R is the gas constant for the reactant gases being compressed and k is the isentropic exponent for these gases. The gas space volume, VR, within the containers depends upon the porosity of the char fuel, % Pore, contained therein, the fractional dead volume of VR, fD, not filled with char fuel, and the total internal volume, VT, of the containers.

$$VR = \frac{(VT)\ (\%\ \text{Pore})}{[(1 - fD)(100) + fD(\%\ \text{Pore})]}$$

For sealed pressure vessel containers, the dead volume will be usually very low when the refuel mechanism is functioning properly. Nevertheless, gas space volume may well vary between separate containers due to variations of the char porosity between containers. For underground coal formation containers, the gas space volume, VR, may well vary between separate containers not only due to variations of char porosity but also due to variations of the dead volume fraction, fD, resulting from different char burn rates in different parts of a coal seam. Since cycle time, tc, is the same for the group of containers connecting into the same compressor and expander, the actual extent of pump up during compression (PM - PO) must differ as between containers having different porosities or dead volume fractions, a higher maximum cycle pressure being reached in those containers having less gas space volume due to lower char porosity or due to lesser dead volume. Hence, whether we set a fixed cycle time or control cycle time by maximum cycle pressures, there will always be some variation of actual maximum cycle pressure as between containers. Most commonly, a cyclic char gasifier plant will be sized to produce a selected product gas output, VPM, at selected maximum and minimum container operating pressures. Preferably, measured data from pilot plant experiments are used to size the plant and its several elements. For example, the following quantities can be measured and calculated from pilot plant experiments with a char fuel:

(mmch)=char mass flow rate into all active containers, mass per unit time

M=compressor air flow rate, mass per unit time

MX=expander gas flow rate, mass per unit time a=molal reaction steam to oxygen ratio mchr)=coke removal rate, mass per unit time (CR)=coke ratio=(mmch)/(mmch)

(tc)=cycle time for one container to undergo a full cycle of compression and expansion, time units (VPM)=gasifier output product gas flow rate, volume units per unit time at standard temperature and pressure (fD)=fractional dead volume of the container gas space volume not filled with char fuel (nc)=number of compressor stages (nx)=number of expander stages (VR)=total gas space volume of all containers being compressed, volume units (TO)=ambient air intake temperature at inlet to lowest pressure compressor stage (PM)=maximum compression pressure, force per unit area (PO)=starting compression pressure, force per unit area (PR)=compression pressure ratio=(PM)/PO)

(wca)=actual compressor work input per unit mass of air compressed, energy units per mass unit (efc)=compressor isentropic efficiency, fractional (wxa)=actual expander work output per unit mass of air compressed, energy units per mass unit
(efx)=expander isentropic efficiency, fractional
(wna)=net work output per unit mass of air compressed, energy units per mass unit
(wna)=(wxa)-(wca)
(wca)(M)=compressor power input
(wxa)(M)=expander power output
(wna)(M)=net power output
(TGMA)=expander maximum inlet gas temperature, absolute degrees These measured data can be usefully graphed in dimensionless form to permit interpolation between pilot plant data points and, to some extent, extrapolation beyond the data. For example, graphs of the following would be useful for plant design and purposes:

(a) Plot (wna) against (TGMA) at various values of compression pressure ratio, (PR). For use in sizing full-scale plants, the measured values of (wca) and (wxa) are preferably corrected for the usually higher values of (efc) and (efx) applicable to larger plant sizes.
(b) Plot (VPM) against M at various values of (a)
(c) Plot (VPM) against MX at various values of (a)
(d) Plot (VR) (tc) against M. A separate graph can be drawn for each different value of (PR) and on each such graph separate lines can be drawn for each value of (a).
(e) Plot produce gas heating value against (a).

Using these measured pilot plant data, a cyclic char gasifier plant can be sized to meet any desired gas generation capacity. For any particular desired capacity, several different plant designs can be used depending upon the plant operating conditions selected of which the following are important:

(1) Increased values of compression pressure ratio yield higher values of work output but require stronger containers and higher pressure compressors and expanders which are more expensive.
(2) Increased compressor inlet air density increases product gas generation capacity.
(3) Increased maximum expander inlet temperature, TGMA, increases work output but requires use of more expensive expander materials or shortens the useful life of the expander.
(4) Increasing the ratio of steam to oxygen reduces work output but increases the product gas heating value.
(5) For any particular plant capacity and operating conditions, a particular value of the ratio, (VR)/(tc), is needed. But several different values of (VR) and (tc) can be used for any one value of this ratio.
(6) Increasing the number of active containers, (nc+nx), by increase of the number of compressor and/or expander stages, will decrease the variation of net power output but will increase the plant cost.

Any consistent system of units can be used for the various measured and calculated quantities described above. The foregoing pilot plant method for sizing a cyclic char gasifier plant is preferred. For cases where pilot plant data are inadequate or unavailable, the approximate analytical relations described hereinabove can be used for approximate plant sizing purposes.

Although the opening and closing of the changeable gas flow connections can be carried out entirely by hand, it will usually be preferable to accomplish this control automatically.

A simple control scheme is to set a particular value of cycle time, tc, and time between changes of connectings, tcc, and then observe the actual maximum cycle pressures, PM, achieved, and then increase tc when PM is too low or decrease tc when PM is too high. This adjustment of tc in response to PM can be done by hand or automatically by methods already known in the art of controls. Other cycle time control methods can also be used as, for example, setting a particular value of PM and when this pressure is reached by each container in turn, a pressure sensor triggers the several valves to change connectings and start the next time interval in the sequence. Whatever cycle time control scheme is used, it functions by actuating the several valves and connections, 39, 58, 59, 60, 61, 62, so that each container in turn is connected in sequence to each compressor stage in order of increasing pressure and then to each expander stage in order of decreasing pressure, and various known control schemes, either electrical or pneumatic or hydraulic, can be readily adapted to this purpose.

One example scheme for control of cycle time is shown schematically in FIGS. 9 and 10. A char gasifier plant comprising a two-stage compressor and a two-stage expander is used for FIG. 9 and comprises six containers, A, B, C, D, E, F, with two containers connected to the two compressor stages, with two containers connected to the two expander stages, with one container being refueled and with one container having coke removed during any one time period in the sequence of time periods of open gas flow connections. Each container is fitted with a pressure actuated switch, SA, SB, SC, SD, SE, SF, which closes when the gas pressure inside the container reaches the intended value of maximum compression pressure, PM. Each container is fitted with four changeable gas flow connections, a refuel mechanism connection, and a coke removal mechanism connection so there are twenty-four changeable gas flow connections, six refuel mechanism connections and six coke removal mechanism connections. These connections for container, A, are shown schematically on FIG. 9 as follows:

AC1, changeable gas flow connection to the lowest pressure compressor stage;
AC2, changeable gas flow connection to the highest pressure compressor stage;
AX1, changeable gas flow connection to the highest pressure expander stage;
AX2, changeable gas flow connection to the lowest pressure expander stage;
ARF, refuel mechanism connecting means;
ARC, coke removal mechanism connecting means.

These same changeable gas flow connections and refuel mechanism connections and coke removal mechanism connections for the other five (5) containers are also shown on FIG. 9 and are similarly designated except the first designator letter is changed to correspond to the container designator. For the example scheme of FIG. 9 the changeable gas flow connections are opened by applying electric power to a solenoid opened valve and these valves are closed by a closing spring. The refuel mechanism and the coke removal mechanism are also solenoid initiated as shown, for example, in FIGS. 7 and 8. Thus, when electric power from the solenoid power source, SP, is applied to the terminal T1 of FIG. 9, the containers will then be connected as follows:

Container A open gas flow connected to the delivery end of the lowest pressure compressor stage;

Container B open gas flow connected to the delivery end of the highest pressure compressor stage;

Container C open gas flow connected to the inlet end of the highest pressure expander stage;

Container D open gas flow connected to the inlet end of the lowest pressure expander stage;

Container E connected to refuel mechanism;

Container F connected to coke removal mechanism.

By applying the solenoid power source, SP, for a time period to each of the terminals T1, T2, T3, T4, T5, T6 and in that sequence, it can be seen that each of the containers shown in FIG. 9 will be carried through the desired sequence as follows:

a sub sequence of time periods of open gas flow connections to each delivery end of each stage of the compressor in order of increasing stage delivery pressure;

a sub sequence of time periods of open gas flow connections to each inlet end of each stage of the expander in order of decreasing stage inlet pressure;

a time period connected to the refuel mechanism;

a time period connected to the coke removal mechanism;

and this sequence can be repeated by repeating the application of the power source, SP, to the terminals, T1, T2, T3, T4, T5, T6. Note also for the wiring diagram as shown in FIG. 9 that each container is opened to only one stage during any one time period and that each delivery end of each stage of the compressor and each inlet end of each stage of the expander has an open gas flow connection to a container during all time periods, provided that only one of the terminals, T1, T2, T3, T4, T5, T6, receives power during any one time period. The solenoid power source, SP, is applied to each of the terminals, T1, T2, T3, T4, T5, T6, in turn, and one at a time in that sequence, by action of the pressure switches, SA, SB, SC, SD, SE, SF, via the cascaded relays shown schematically in FIG. 10, wherein only three, R1, R2, R3, of the six cascaded relays are shown.

Each cascade relay, such as R1, comprises a single coil solenoid switch, S1, with upper switch terminals, 158, closed when energized and with lower switch terminals, 159, closed when deenergized, and a double coil solenoid switch, D1, with two separate switch terminals, 160, 161, closed when energized, switch terminals, 158, 160, and 161 being spring opened. As shown in FIG. 10, the terminal T1 is connected to SP via the terminals, 165, of single coil switch, S2, and the switch terminals, 161, and one coil of D1 and the coil of S1 are also energized thusly. During the time period when T1 is thusly energized from SP, it is container B which is being pumped up to maximum compression pressure, and it is the pressure switch, SB, on container B which is connected to the double coil switch, D2, of cascade relay R2 via switch terminals 160 and 158. When container B reaches the value of maximum compression pressure, PM, set into the pressure switch, SB, this switch closes and applies power from source PP to one coil of the double coil switch D2 which thus closes switches, 162, 163, energizes single coil switch, S2, and closes switch terminal, 164, and opens switch terminals, 165, and disconnects solenoid power source SP from terminal T1, and then connects solenoid power source SP to termina1 T2. A first time period of the sequence will thus end and the next time period commence during which container B will now be connected to the highest pressure expander stage and it will be container A, now connected to the highest pressure compressor stage, whose pressure switch, SA, will next act to end the time period. When single coil switch S2 was energized and switch terminals 165 were opened, the double coil switch D1 and the single coil switch S1 were deenergized, thus opening switch terminals 160, 161, and 158 and thus the pressure switch, SB, is also disconnected, but the double coil switch D2 is now energized via the switch terminals 163 and the switch terminals, 166, of single coil switch S3 of relay R3. Accordingly, cascade relay R2 is now arranged during the second time period in the same way as cascade relay R1 was during the first time period and thus when container A is pumped up to the set value of maximum compression pressure, the same events will take place and thus disconnect power from T2, apply power to T3, disconnect pressure switch SA, connect pressure switch SF, and thus change over to a third time period. The cascade relay system shown in FIG. 10 thus applies solenoid power to the terminals T1, T2, T3, T4, T5, T6, in turn. and in that sequence and, since cascade relay R6 connects similarly into cascade relay T1, this sequence of connections is repeated again and again. In this way, the desired sequence of open gas flow connectings and refuel and coke removal connectings is carried out for each container, and is repeated, and each container is brought up to the desired maximum pressure of compression before being expanded. The desired maximum pressure of compression is set by adjusting, as by hand, the closing pressures of the several pressure switches SA, SB, SC, SD, SE, SF. For startup a pressure switch bypass switch, SS, can set any one of the cascade relays, say R3, and when the compressor and expander are started up, the sequence can commence soon thereafter. A wide variety of cascade relay systems and pressure switch systems can also be used to carry out the desired sequence and FIG. 9 and 10 are only intended as a typical illustrative example. Electronic control schemes can be substituted for this cascade relay scheme as is well known in the art of electronic controls. Wbere final container pump up is with an inert gas of essentially zero oxygen content, it may sometimes be preferred to control cycle time by the maximum pressure of compression reached on air or oxygen containing gas, rather than on the inert gas, since the needed inert pumping may be very slight where the fractional dead volume, fD, is small as is preferred. This can be readily arranged by having the pressure switch on that container undergoing inert pumping disconnected by action of the solenoid which opens the gas flow connection to the delivery end of the separate inert pumping compressor and suitably rewiring the cascade of relays. The aforedescribed scheme for control of cyclic time is seen to comprise the following:

a. means for opening and closing the changeable gas flow connections, in the form of the solenoids and return springs on the valves such as AC1, AC2, BX1, BX2, etc., together with the solenoid power source, the pressure switches, and the cascade of relays;

b. means for connecting and disconnecting the refuel mechanism, in the form of the refuel initiating solenoids, such as ARF, and connected linkage, together with the solenoid power source;

c. means for connecting and disconnecting the coke removal mechanism, in the form of the coke removal initiating solenoids, such as ACR, and connected linkage, together with the solenoid power source;

d. means for controlling the above means for opening and closing and means for connecting and disconnecting so that each container goes through the desired sequence of open gas flow connections, and refueling, and coke removal, in a continuous series of time periods, and so that each compressor stage delivery and each expander stage inlet always has a container connected, in the form of the grouping of the solenoids connected to the terminals T1, T2, T3, T4, T5, T6, and the cascade of relays.

Where a constant cycle time is preferred, the aforedescribed scheme can be modified by replacing the pressure switches and cascade relays by a motor-driven switch which directs electric power to the terminals T1, T2, T3, T4, T5, T6, in the desired sequence. The speed of the switch drive motor can then be adjusted so that the desired maximum pressure of compression is reached. This motor speed adjustment can be done by hand or automatically.

One example pneumatic-hydraulic scheme for control of cycle time is shown schematically in FIGS. 16 and 17. In lieu of the solenoid operated changeable gas flow connections of the FIG. 9 and 10 cycle time control scheme, pneumatically operated valves are used for AC1, BC2, CX1, DX2, etc., of which only one, say AC1, is shown in FIG. 16. The valve, 227, is opened or closed by applying pneumatic pressure to the open face, 228, or the close face, 229, respectively, of the drive piston, 230, while venting the opposite face via the pipes, 231, and, 232. Pneumatic pressure and venting are applied to the pipes, 231, 232, as well as the corresponding pipes of the other valves or actuators in the group to be simultaneously opened or closed, by the cam driven spool valve, 233, which is moved up by the lifted section, 234, of the cam, 235, and is moved down by the return spring, 236. As shown in FIG. 16, the spool valve, 233, is up on the cam lifted section, 234, and pneumatic pressure from pneumatic pressure supply pipe, 237, is applied via pipe, 231, to the open faces, 228, of the drive pistons, or other actuators such as for refuel or coke removal, while the close faces are vented via the vent, 238, and the valves, 227, is thus opened. When the cam moves on the spring, 236, will subsequently force the spool valve follower, 239, back on to the cam base circle, 240, and pneumatic pressure will then be applied via pipe, 232, to the close faces, 229, of the pistons, 230, while the open faces, 228, will be vented via the vent, 241, and the valves, 227, will then be closed. Each set of valves and actuators which are to be simultaneously opened or closed will require its own spool valve such as, 233, but all can be driven by the same cam, 235, if properly spaced angularly thereabout or, alternatively, each spool valve can be driven by its own cam. In either case, the spool valves and cams must be so arranged that one set of valves is closed when the next set of valves in the sequence is opened. Hence, the time interval between changes of connectings, tcc, in minutes equals the arc length, in degrees, of the lifted section, 234, divided by 360 times the revolutions per minute of the cam, 235. A fixed cam speed will yield a fixed value of tcc and hence also of tc. But tcc and tc can be adjusted, if desired, by use of an adjustable speed cam drive mechanism such as the hydraulic drive scheme shown schematically in FIG. 17. An adjustable swash plate hydraulic pump, 242, is driven, as via a reduction gear box, 243, from the compressor shaft, 244, and the pump displacement can be adjusted by adjusting the swash plate via the pump control lever, 245. The hydraulic motor, 246, of fixed displacement, drives the spool valve cam, 235, and is itself driven via the pressure line, 247, from the pump, 242, hydraulic fluid return being via the pipes, 248, 249, and the fluid reservoir, 250. The hydraulic motor, 246, speed and hence the cam speed can be adjusted by adjusting the hydraulic pump, 242, displacement via the lever, 245, increasing pump displacement increasing motor speed and vice versa. Increasing pump displacement increases cam speed and hence shortens the cycle time and vice versa. In this way, the cycle time can be adjusted either by hand adjustment of the swash plate lever, 245, or automatically in response to container pressures reached during compression. One example automatic cam speed control device is also shown in FIG. 17 and comprises a piston, 251, which adjusts the swash plate lever, 245, an adjustable spring, 252, acting in opposition to gas pressure applied to the piston, 251, via the bleed check valve, 259, from the pipe, 253, the opposite piston face being vented to atmosphere via the passage, 254. The pipe, 253, connects to the highest pressure compressor stage delivery end, or the delivery end of that highest pressure compressor stage which compresses air preferably for oxidation plants. The bleed check valve, 259, allows ready flow of compressed gas into the cylinder, 255, but only a slow bleed of return flow out of the cylinder and hence the pressure in the cylinder, 255, will be reasonably steady and close to the maximum gas pressure experienced in the pipe, 253. Thus, as maximum container compression pressure rises, the piston, 251, moves the swash plate lever, 245. in the direction, 256, which increases pump displacement to speed up the motor, 246, and cam, 235, and hence to shorten the cycle time. As maximum container compression pressure decreases, the lever, 245, is moved in the direction, 257, which slows the cam, 235, and lengthens the cycle time. In this way, the devices shown in FIG. 17 can function to hold maximum compression pressure at or near a desired value and this desired value can be adjusted by adjustment of the spring control nut, 258. An adjustable speed electric motor could be substituted for the adjustable speed hydraulic drive.

Wholly mechanical cycle time interval controllers can also be used with the cams acting directly as valve actuators and refuel or coke removal actuators.

Where the containers are underground coal formations, the gas space volume, VR, necessarily increases with time since consumption of the coal in the formation increases both the dead volume fraction, fD, and the total container volume, VT. Hence, for this particular case, it may be preferred to set a particular maximum cycle pressure, PM, to be reached and prolonging the cycle time until this pressure is reached by each container. Thus, as underground gasification proceeds, the cycle time lengthens and eventually a new set of boreholes and containers should be connected up and the old set of boreholes and containers discarded as effectively burned up.

While the cycle time is determined by the rate at which the compressor can pump up the containers to the maximum cycle pressure, the expanders are required to expsnd the reacted gases within these containers back down to minimum cycle pressure within that portion of the cycle time available for expansion. This assurance of adequate expansion can be obtained by use of the expander flow rate controllers already described hereinabove. So that the time interval between changes of gas flow connectings, tcc, can be the same for all of the several containers in use on an oxidation gasifier with a multistage compressor, a multistage expander, and sealed pressure vessel containers, the ratio of container pressure rise across a single stage to the mass flow rate of all gases into the container connected to that stage shall be equal for all compressor stages, and further, the ratio of container pressure drop across a single stage to the mass flow rate of all gases out of the container connected to that stage shall be equal for all expander stages.

One example of an expander flow rate control scheme is shown diagramatically in FIG. 11 wherein an expander inlet pipe, 167, supplies reacted gas to the adjustable, non-rotating inlet nozzle guide vanes, 168, which direct the expanding reactant gases against the rotating turbine blades, 169, to produce work. The nozzle flow area between the inlet guide vanes, 168, can be adjusted by rotating these guide vanes about their pivots, 170, by the levers, 171, with each guide vane, 168, having a lever, 171, and these levers are connected together by links, 172, so that all inlet guide vanes are rotated together similarly. The levers, 171, are thusly rotated by the arm, 173, moved in turn by a nut fitting the threaded shaft, 174. The threaded shaft, 174, is rotated so as to open the nozzle flow area by the open motor, 175, and is rotated so as to close the nozzle flow area by the close motor, 176, these being electric motors and preferably constant speed electric motors. The expander inlet pipe, 167, is fitted with a high pressure cut in switch, 177, which closes whenever the inlet pressure exceeds the value set on this switch, and a low pressure cut in switch, 178, which closes whenever the inlet pressure is at or below the value set on this switch. The set value for the high pressure switch, 177, is set, as by hand, to equal or slightly exceed the intended maximum expander inlet pressure. The set value for the low pressure switch, 178, is set, as by hand, to equal or be slightly less than the intended minimum expander inlet pressure. Whenever expander inlet pressure exceeds the intended maximum pressure, the open motor, 175, is energized via the power source, 179, the high pressure switch, 177, and the open limit switch, 180, and the nozzle flow area is increased in order to empty the connected containers more quickly so that the intended minimum pressure will be reached during the time period available. The open limit switch, 180, prevents further nozzle opening after full opening has been reached and the lever, 173, has engaged and opened the limit switch, 180, preventing energizing of the open motor, 175. Whenever expander inlet pressure is below the intended minimum pressure, the close motor, 176, is energized via the power source, 179, the low pressure switch, 178, and the close limit switch, 181, and the nozzle flow area is decreased in order to decrease the rate of emptying of the next connected container so that the expander inlet pressure will not drop below the intended minimum pressure during the time period available. The close limit switch, 181, prevents further nozzle closing after maximum closing has been reached and the lever, 173, has engaged and opened the limit switch, 181, preventing energizing of the close motor, 176. This expander flow rate control scheme thus acts to assure that each container is expanded down to essentially the same desired minimum pressure within the time period available. An electrically energized expander flow rate controller is shown in FIG. 11 but hydraulic or pneumatic control schemes can also be used as is well known in the art of expander flow rate controllers. Nozzle flow area is controlled by the scheme shown in FIG. 11 but a similar control could act instead to adjust a throttle valve in the expander inlet pipe or to adjust the cutoff timing on a piston expander.

The largest fluctuation of net rate of work output occurs at each change of connectings. Just prior to the change, all containers being compressed are near to full pressures for the interval and compressor work rate is maximum, whereas all containers being expanded are near to minimum pressures for the interval and expander work rate is minimum, the one expanding container about to disconnect from the expander producing essentially no work. Just after a change of connectings, all containers being compressed are at lowest pressures for the interval, the one container just connected to the lowest pressure stage of the compressor requiring essentially no work, whereas all containers being expanded are at maximum pressures for the interval and expander work rate is maximum. This largest work rate fluctuation can be approximated as equal to the sum of the maximum work rate of the lowest pressure stage of the compressor and the maximum work rate of the lowest pressure stage of the expander and clearly can be made as small as required by increasing the number of compressor stages, nc, and by increasing the number of expander stages, nx. In FIGS. 3 and 4 the number of compressor stages is shown equal to the number of expander stages but this is not necessary. An expander stage as herein defined may be a work output producing expander engine or a non work output producing blowdown expander.

For the particular oxidation gasifier example shown in FIG. 3, the separate inert gas compressor, 23, is supplied at its inlet with reacted gases from the discharge of the highest pressure expander stage, 25, via the connection, 53. Thus, this final compressor stage, 23, pumps reacted gas, very low in or essentially free of both steam and oxygen, into the containers for the final pump up, and in this way the Neumann reversion reaction can be suppressed as explained hereinabove. This final pump up with gases differing from those compressed by the lower pressure stages is not usually preferred for devolatilization gasifiers.

The example oxidation gasifier plant with multistage compressors and expanders shown in FIG. 3 is also shown with high pressure steam being admitted along with the air, via the connections and valves, 54, 56, and 55, 57, to all those compressor stages compressing gases high in oxygen content. As explained hereinabove, this steam admission produces a richer product output gas at 52 and also reduces expander inlet temperatures to practical values and hence will be preferably used in cases where expander engines with work output are to be used. Preferably, high pressure steam is used so that it can be admitted into the air flow after the air is compressed and in this way the net work of compressing the reactant gases is minimized. The source of this high pressure steam can be any one or a combination of kinds of high pressure steam boilers such as, a product reacted gas fired self compensating boiler, or a boiler fired separately from the gasifier plant, or a separately fired boiler whose feedwater heaters and air heaters are product reacted gas fired.

Separately fired boilers provide simplified control since the gasifier plant can take whatever steam is required and the usual boiler controls can adjust the fuel firing rate accordingly, up to the capacity of the boilers. On the other hand, the product reacted gas leaving the discharge of the lowest pressure stage of the expanders, as for example at 52 in FIG. 3, is at a high temperature and those portions which may be used as reactant gases in a subsequent devolatilization gasifier and also those portions which may be pumped to market via pipelines will preferably be precooled to lower temperatures in order to reduce the subsequent work of compression or pumping. This preferred cooling of the product reacted gases can be used to generate the high pressure steam for the oxidation gasifier. Where the entire reacted gas flow is utilized to generate the entire supply of high pressure steam for the oxidation gasifier, a self compensating boiler results in that if extra steam happens to form, its effect on the oxidation reaction reduces the product reacted gas temperature and, hence, reduces the steam formation to correct the excess. The reverse effect occurs when steam formation happens to decrease a bit and in this way an equilibrium steam to air (or oxygen) ratio prevails when this self compensating boiler is used. For example, an oxidation gasifier using air and steam whose cycle pressure ratio is 34 to 1 has an estimated equilibrium steam oxygen ratio, a, of about 0.54, when using such a self compensating boiler. When steam oxygen ratios are to be greater than this equilibrium value, a supplementary boiler or preferably a separately fired boiler is used. Where a separately fired boiler is used alone, some of the desired product reacted gas cooling can yet be accomplished by firing all or a portion of these gases to the feedwater heater and/or the air preheater of the separately fired boiler, but the product reacted gas must be kept separate from the combustion gases of the separate firing. The extra char fuel required for firing separately to a boiler to furnish the steam to an oxidation gasifier is a small portion of the total char fuel being used by the char gasifier plant, being less than one percent thereof for the above case at a steam oxygen ratio of 1.2. The separately fired boiler can be used for all useable values of steam oxygen ratio and additionally can be used as a means of controlling expander inlet temperatures, or product gas ratio of hydrogen to carbon monoxide, as is describe hereinabove. The separately fired high pressure steam boiler can also be used at gasifier plant startup as a source of steam for spinning up the compressors and expanders.

Various means for stopping the char gasifier plants of this invention can be used, such as:

a. Supply sufficient excess steam for stopping to containers being compressed so that the char fuel becomes chilled well below its rapid reaction temperature by the endothermic steam-char reaction.
b. Recirculate reacted gas, essentially free of oxygen gas, into the air compressor intake and the oxidation gasification reactions cease due to lack of oxygen.
c. Where the compressor is separately driven, it can simply be turned off.

An example of an excess steam stopping means is shown schematically in FIG. 12 and comprises a steam stopping valve, 220, which when opened feeds excess steam into the containers, 86, 87, 88, undergoing compression with air, via the metering orifices, 221, 222, 223, which assure adequate excess steam into each container as to assure stopping. The valve 220 is only to be opened when the plant is to be stopped.

An example of a recirculated reacted gas stopping means is shown in FIG. 15, as applied to the cyclic char gasifier plant of FIG. 2, and comprises a selector valve, 224, in the supply pipe, 73, of the compressor, 70, with an air supply pipe, 225, and a reacted gas recirculation pipe, 226. As shown in FIG. 15 the compressor, 70, is being supplied with air. When the plant is to be stopped, the valve, 224, is rotated ninety degrees and the compressor is then supplied with reacted gas via the pipe, 226, and the char oxidation gasification reactions stop.

Oxidation gasifier plants and devoltilization gasifier plants can be used alone or in combinations. It will usually be preferable to use devolatilization plants in combination with oxidation gasifier plants so that the low oxygen content reactant gases for the devolatilization processes can be supplied as the product reacted gases from the oxidation processes and further so that these gases will be enriched by the addition of the gases evolved during devolatilization. The combination of a compressor, an expander, and connected containers and work units is herein and in the claims referred to as a gasifier plant. Two or more such plants connected together constitute a gasifier system. For example, one or more oxidation gasifier plants connected jointly as described above to one or more devolatilization gasifier plants is such a system and is herein referred to as a devolatilization-oxidation char gasifier system. For these devolatilization-oxidation gasifier systems, we prefer to cool down the hot reacted gases from the oxidation process before compressing them as reactant gases for the devolatilization process in order to minimize the work of this compression. Additionally, we prefer to subsequently heat up the compressed reactant gases before they are forced into the char pores in a devolatilization process, partly to speed up the devolatilization, and partly to aid in producing a net work output from the devolatilization plant. Various types of heaters and coolers can be used alone or in combination for this precooling and post heating of the reactant gases for a devolatilization gasifier plant. For example, a self-compensating steam boiler or the feedwater heater and air preheater portions of a separately fired steam boiler can be used as described above for all or a portion of the precooling of the reacted gases from oxidation gasifier plants. The reacted gases from the oxidation gasifier plant can also be used as the heat source for the post heating of the compressed reactant gas for the devolatilization gasifier plant and will be concurrently cooled thereby. The large gas temperature gradient which can be caused by the manner of occurrence of the oxidation gasification reaction at rising pressures as described hereinabove may cause large temperature differences to exist also in the product reacted gases leaving the expander discharge, with those reacted gas portions which are last to leave the containers being hotter than those reacted gas portions which first left the containers. This reacted gas temperature difference can be used advantageously for the post heating of the compressed reactant gases going to a devolatilization plant wherever these different reacted gas portions can be kept separated, as for example by directing the hottest oxidation process reacted gas portions to the post heating of the compressed reactant gases from the highest pressure stage of the devolatilization plant compressor, and directing the lower temperature portions of the oxidation process reacted gas to the post heating of the compressed reactant gases from the lower pressure stages of the devolatilization plant compressor. Separately cooled coolers and separately fired heaters can also be used either alone or in combination with coolers and heaters such as those described above.

Where vacuum pumps and vacuum expanders are used with devolatilization gasifier plants, as described hereinabove to increase gas and liquid yields of devolatilization, a modified sequence of gas flow connectings of the containers is used and the preferred time for container refuel and coke removal connectings may also be modified. After a container has been expanded fully down to the final product reacted gas discharge pressure, it is then connected first to the vacuum pump until the intended vacuum is reached, and next to the vacuum expander, after which the container is ready for connection again to the lowest pressure stage of the compressor. Since we prefer refuel and coke removal to occur when a container is nearest to ambient pressure, these can then be timed to occur either during the vacuum process if and when pressures there come closest to ambient, or during the compression and expansion process if and when pressures there come closest to ambient.

One particular example of a devolatilization-oxidation char gasifier system is shown schematically in FIG. 5 as a means of illustrating the following: the use of oxidation gasifier in functional combination with devolatilization gasifiers; the use of varying steam oxygen ratios during compression of oxidation gasifiers; the use of separate expanders to produce two separate and different product gases; the use of precompression coolers and post compression heaters with the devolatilization plant compressor. FIG. 5 is a simplified schematic diagram of this plant and not all connecting means are shown but only those in use at the moment and needed for the explanation. The devolatilization-oxidation char gasifier system shown in FIG. 5 comprises an oxidation char gasifier plant, 80, connected and operated in combination with a devolatilization char gasifier plant, 81. The oxidation char gasifier plant, 80, comprises the following:

a. A compressor with three stages, 82, 83, 84, a separate inert gas compressor, 85, and these connected to four oxidation gasifier containers, 86, 87, 88, 89, the last compressor, 85, pumping up the container, 89, with partially expanded reacted gases from the first expander, 91.

b. A first expander engine with two stages, 91, 92, which connect to two containers, 93, 94, first after completion of compression, and whose final discharge gases do not enter the second expander engine. These first expanded reacted gases pass instead, via precompression coolers, 100, 101, and become the reactant gases supplied to the devolatilization char gasifier plant, 81.

c. A second expander engine with two stages, 95, 96, which connect to two containers, 97, 98, only after these containers have previously been connected to both stages of the first expander engine, and whose final discharge gases are the last expanded reacted gases. These last expanded reacted gases pass via post compression heaters, 102, 103, to the lean product gas output pipe, 104.

d. An electric generator, 90, to absorb the net work output of the oxidation char gasifier plant, 80.

e. Two more containers, 105, 106, which are first refueled at 105 and then have coke removed at 106.

f. A separately fired high pressure steam boiler, 107, whose feedwater is preheated by the precompression cooler, 100, and pumped into the boiler by the feedwater pump, 108, and whose output of high pressure steam is added to the compressed air from compressor stages, 82, 83, 84, and goes into containers 86, 87, 88, via steam connections 109, 110, 111. The steam oxygen ratio is greatest for container 88 and least for container 86, so that the steam oxygen ratio if variable as between containers, increases as compression of each container proceeds, but is essentially constant at any one pressure.

g. The oxidation gasifier containers are shown in FIG. 5 as "frozen" to the one set of connectings shown, but, of course, each container actually proceeds through the sequence of being connected in turn to each compressor stage and then to each expander stage and is then refueled and has coke removed. As time progresses from that shown in FIG. 5, container 86 will in sequence be connected as is shown in FIG. 5 for containers 87, 88, 89, 93, 94, 97, 98, 105, 106, and in that order and all these containers will follow in their turn this same sequence of connectings. In this way, the basic process cycle of compression followed by expansion is carried out and is repeated. The devolatilization char gasifier plant, 81, comprises the following:

h. A compressor with two stages, 112, 113, which compresses the pre-cooled first expanded reacted gas from the oxidation gasifier plant into two containers, 114, 115, via the post compression heaters, 102, 103.

i. An expander engine with two stages, 116, 117, which connect to two containers, 118, 119, and whose final discharge gas passes to the rich product gas output pipe, 120.

j. An electric motor generator, 121, to absorb the supply the work input of the devolatilization char gasifier plant, 81.

k. Two more containers, 122, 123, which are first refueled with raw input char fuel at 122 and then have coke removed at 123. The devolatilized coke removed at 123 can be used in whole or part as all or a portion of the char fuel being refueled to the oxidation char gasifier plant at 105.

l. The devolatilization gasifier containers are shown in FIG. 5 as "frozen" to the one set of connectings shown but, of course, each container actually proceeds through the sequence of being connected in turn to each compressor stage and then to each expander stage and is then refueled and has coke removed. As time progresses from that shown in FIG. 5, container 114 will in sequence be connected as is shown in FIG. 5 for containers 115, 118, 119, 122, 123, and in that order and all these containers will follow in their turn this same sequence of connectings. In this way, the basic process cycle of compression followed by expansion is carried out and is repeated.

The principal net input materials to the example devolatilization-oxidation char gasifier system of FIG. 5 are as follows:

1. Raw fresh char fuel, such as run of the mine coal, is being refueled into devolatilization containers as at 122.
2. Ambient air enters the inlet, 124, of the lowest pressure stage, 82, of the oxidation gasifier plant compressor.
3. Boiler make up feedwater enters, at 125, the precompression cooler, 100, which is also a feedwater heater, and then is pumped into the boiler, 107.

4. An external cooling medium such as air or water may be used, if desired, for additional precompression cooling in the cooler, 101.
5. Although fresh char fuel can also be refueled into oxidation containers, as at 105, and can be used as the fuel for the separately fired boiler, 107, it will usually be preferable to internally refuel the oxidation gasifier containers and to internally fuel the separately fired boiler with devolatilized char fuel taken from devolatilization containers as at 123.
6. Ambient air is supplied to the furnace of the boiler, 107, and may be preheated, if desired, as via a precompression cooler such as 101. This supply is not shown in FIG. 5.

The principal net output materials from the example devolatilization-oxidation char gasifier system of FIG. 5 are as follows:

7. A separate lean product gas emerges at pipe 104.
8. A separate rich product gas emerges at pipe 120, which has been enrichened in heating value, partly by the varying steam oxygen ratios utilized in the oxidation gasifier plant, 80, and partly by the volatile matter removed from the char fuel in the devolatilization gasifier plant, 81.
9. A partially-oxidized coke may be removed as an output product of the oxidation gasifier plant, as at 106, or if full oxidation of char fuel is utilized, the ashes are discharged therefrom.
10. Devolatilized char fuel may be removed as an output product of the devolatilization gasifier plant, as at 123, over and above any devolatilized char fuel needs of the oxidation gasifier plant and the boiler.
11. The boiler flue gases and also ashes emerge from the furnace of the boiler, 107, and this is not shown in FIG. 5.

Other input items, such as oxygen enrichment of the reactant gases of the oxidation gasifier plant, and other output items, such as condensed liquid fuels and chemicals from the reacted gases of the devolatilization gasifier plant, may also be used. Also, the raw, fresh char fuel refueled can be different for different containers and can differ between different refuelings of the same container. For example, coal and oil shale can be utilized in combination so that the volatile hydrocarbon portion of the oil shale can act to greatly enrichen the product gas output. The oil shale can be utilized continuously in only some of the containers, or can be utilized intermittently in all or some of the containers, or can be blended proportionately with coal and the blend refueled to all containers, for this enrichening purpose. Other sources of hydrocarbons, such as Bunker C fuel oil, can also be used for gas enrichment.

An additional output from the gasifier system of FIG. 5 is the electric power from the generator, 90. Additional electric power output may also be obtained from the generator, 121, provided that post compression heaters, 102, 103, and the pre compression coolers, 100, 101, are of adequate capacity.

One example scheme for controlling maximum expander inlet temperature by controlling the steam to oxygen ratio during compression is shown schematically in FIG. 12 as applied to the oxidation gasifier plant, 80, of FIG. 5. Steam is generated in the boiler, 107, at a pressure greater than the maximum pressure achieved during compression with gases containing appreciable oxygen, which for FIGS. 5 and 12 is the maximum pressure reached by the compressor stage, 84. The steam passes, via the pressure regulating valve, 182, to the steam metering orifices, 109, 110, 111, and from there into the compressed gas streams flowing out from the compressor stages, 82, 83, 84, respectively, into the connected containers. The steam quantity flowing into any one of the connected containers, and hence the steam to oxygen ratio, is determined in part by the area of the metering orifice and in part by the upstream orifice pressure set by the pressure regulating valve, 182, more steam flowing at larger areas and higher pressures. The orifices, 109, 110, 111, can be differently sized in order to achieve either an essentially constant steam to oxygen ratio during compression with oxygen containing gases or, preferably, an increase in steam to oxygen ratio as container pressure increases. A vapor pressure temperature sensor, 183, is located in the inlet pipe, 189, of the highest pressure expander stage, 91, and acts via the sealed bellows, 184, spring, 185, and link, 186, to open the increase valve, 187, when expander inlet temperature is too high, and to open the decrease valve, 188, when expander inlet temperature is too low, these two valves being spring closed. The steam pressure regulating valve, 182, functions to maintain its downstream pressure upon the orifices, 109, 110, 111, essentially equal to the pressure applied by a regulating gas to its regulating chamber, 190. The increase valve, 187, when open admits high pressure regulating gas from a source, 191, via an orifice, 192, to the regulating chamber, 190, and thus acts to increase steam pressure on the orifices and hence acts to increase steam flow rates and to decrease expander inlet temperature. The decrease valve, 188, when open bleeds gas out of the regulating chamber, 190, via an orifice, 193, and thus acts to decrease steam pressure on the orifices and hence acts to decrease steam flow rates and to increase expander inlet temperature. In this way, the control scheme of FIG. 12 functions to control expander inlet temperature, as well as steam to oxygen ratio, within set limits. These limits of temperature and steam to oxygen ratio are set by the spacing of the valves, 187, 188, relative to the link, 186, and the compression of the spring, 185, and these spacings and compressions can be adjusted, as by hand, to adjust the set limits of expander inlet temperature. A vapor pressure temperature sensor, 183, is shown in FIG. 12 but other temperature sensors, such as thermocouples with electrical control circuits, gas pressure sensors, or bimetallic temperature sensors, could alternatively be used. A hand adjusted steam pressure regulating valve could be substituted for the automatic steam pressure regulating valve shown in FIG. 12, when hand control of expander inlet temperature and steam to oxygen ratio was preferred.

An example of one scheme for control of the ratio of oxygen to nitrogen in the gases being compressed into containers is shown schematically in FIG. 13 as applied to the oxidation gasifier plant, 80, of FIG. 5. Gaseous oxygen is generated in the oxygen plant, 194, such as liquid air separation plant, at a pressure greater than the maximum pressure achieved during compression with gases containing appreciable oxygen, which for FIGS. 5 and 13 is the maximum pressure reached by the compressor stage, 84. The oxygen passes, via the pressure regulating valve, 195, to the oxygen metering orifices, 196, 197, 198, and from there into the compressed gas streams flowing out from the compressor stages, 82, 83, 84, respectively, into the connected containers. The extra oxygen quantity flowing into any one of the connected containers and hence the oxygen to nitrogen ratio, is determined in part by the area of the metering orifice and in part by the upstream orifice pressure set by the pressure regulating valve, 195, more oxygen flowing at larger areas and higher pressure. The orifices, 196, 197, 198, can be differently sized in order to achieve either an essentially constant oxygen to nitrogen ratio during compression with oxygen containing gases or, preferably, an increase in oxygen to nitrogen ratio as container pressure increases. An oxygen fraction sensor, 199, is located in the delivery pipe, 200, of the highest pressure compressor stage, 84, and acts via the electronic controller 201, to solenoid open the increase valve, 202, when the oxygen to nitrogen ratio is too low, and to solenoid open the decrease valve, 203, when the oxygen to nitrogen ratio is too high, these two valves being spring closed. The oxygen pressure regulating valve, 195, functions to maintain its downstream nressure upon the orifices, 196, 197, 198, essentially equal to the pressure applied by a regulating gas to its regulating chamber, 204. The increase valve, 202, when open admits high pressure regulating gas from a source, 205, via an orifice, 206, to the regulating chamber, 204, and thus acts to increase oxygen pressure on the orifices, and hence to increase oxygen flow rates, and hence to increase oxygen to nitrogen ratios. The decrease valve, 203, when open bleeds gas out of the regulating chamber, 204, via an orifice, 207, and thus acts to decrease oxygen pressure on the orifices, and hence to decrease oxygen flow rates and hence to decrease oxygen to nitrogen ratios. In this way, the control scheme of FIG. 13 functions to control oxygen to nitrogen ratios during compression within set limits. These limits of oxygen to nitrogen ratio are set into the electronic controller, 201, and can be adjusted, as by hand adjustment of the knob, 208. A hand adjusted oxygen pressure regulating valve could be substituted for the automatic oxygen pressure regulating valve shown in FIG. 13, when hand control of oxygen to nitrogen ratio was preferred.

When oxygen enrichment is used, expander inlet temperatures can increase since diluent nitrogen content is reduced and hence extra steam will usually be preferred in order to keep expander inlet temperatures within acceptable limits. The expander inlet temperature control scheme described above can be used together with the oxygen to nitrogen ratio control scheme, also described above, to automatically increase steam flow with oxygen enrichment in order to maintain expander inlet temperatures within set limits. Alternative control schemes can also be used, for example, steam flow rate could be held constant and oxygen flow rate adjusted in order to control expander inlet temperatures.

With single stage compressors steam to oxygen ratio can be varied during compression in various ways, as for example by adjusting the steam metering orifice area to increase as compression pressure increases. Alternatively, steam pressure to the metering orifice could be increased as compression pressure increases in order to increase steam to oxygen ratio as compression pressure rises. Similar control means can also be used for variation of the oxygen to nitrogen ratio during compression when oxygen enrichment is used with single stage compressors.

Various combinations of char gasifier plants can be used to create char gasifier systems. As another example char gasifier system, a single devolatilization char gasifier plant can be functionally connected to two oxidation char gasifier plants, one of which uses devolatilized mined coal refueled into sealed pressure vessel containers, and the other of which uses underground coal formations as containers. This latter char gasifier system would be particularly suited for use in areas where both readily mineable coal and also tightly bound coal, difficult to mine, were available.

One scheme for using vacuum pumps and vacuum expanders is shown schematically in FIG. 14 as adapted to the devolatilization plant, 81, of FIG. 5 and comprises a vacuum pump, 209, pumping out the extra container, 210, into the product gas collector pipe, 120, and a vacuum expander, 211, expanding fresh reactant gas from the reactant supply pipe, 212, into another extra container, 213, and extra changeable gas flow connections such as 214 and 215, from the vacuum pump and from the vacuum expander to each of the several container means, 114, 115, 118, 119, 122, 123, 210, 213. Preferably, the vacuum pump is connected into after a container has complete expansion into the expander, 117, the vacuum expander is next connected into and thereafter refuel and coke removal take place before a container restarts the sequence by again connecting into the low pressure compressor stage, 112. A drive motor, 216, supplies the work needed by the vacuum pump, 209, which is in excess of the work supplied by the vacuum expander, 211. Single stage vacuum pumps and vacuum expanders are shown in FIG. 14 but multistage vacuum pumps and vacuum expanders could alternatively be used if desired.

The several examples of char gasifier plants and systems presented above illustrate, not only various apparatus and process details, but also the capabilities of these plants and systems to utilize a wide variety of input char fuels for producing a wide variety of output products whose relative volumes can be adjusted over a wide range. This is one of the beneficial objects made available by this invention, to match available char fuel resources to market needs. Prior art char gasifier systems utilize only a rather narrow range of input fuels, and produce only a limited variety of output products and these in relatively fixed proportions. Additionally, the preferred machines of this invention can produce a useful work output from the heat of the gasification reaction and this is an additional beneficial object not available from prior art char gasifier systems.

The machines of this invention are similar in some ways to those described in the cross-referenced related applications and differ therefrom in various ways, of which the following are examples. The containers or combustion chambers of this invention are detached from the compressor and the expander but connect to both of them at different times via the connecting means. In the devices of the cross-referenced applications, the combustion chamber, the compressor and the expander are together and are always interconnected so that no connecting means is used. One consequence of this difference is that the devices of this invention are less suitable for generating work output from the complete oxidation of the char fuel to carbon dioxide and water whereas the devices of the cross-referenced applications can be used in this way as is described therein. A further consequence of this difference is that the devices of this invention can be used to create two or more differing product fuel gases as output, as is described herein, whereas the devices of the cross-referenced applications can produce but a single gas output stream since the combustion chamber is always connected to but a single expander.

The net work output variations described hereinabove can be essentially eliminated by use of an external torque leveller engine and governor system such as is described in my cross-referenced U.S. Pat. No. 4,433,547 entitled, "Torque Leveller."

Where two or more separated product reacted gases are to be produced, two or more separate expanders can be used as described hereinabove. Alternatively, and usually less expensively, a single expander can be used whose expanded reacted gas is similarly divided into separated product reacted gases by an exhaust divider valve as described in my co-pending cross-referenced U.S. patent application, Ser. No. 06/628,150, entitled, "Cyclic Char Gasifier With Product Gas Divider." The exhaust divider valve is so driven and controlled as to direct one portion of expanded product reacted gas leaving each container into one product gas collector pipe and to similarly direct other portions of expanded product reacted gas into other, separate, product gas collector pipes during each time interval between changes of gas flow connections, tcc.

Having thus described my invention, what I claim is:

1. A process for gasifying at least two char fuel masses within separate containers, comprising the steps of:

preheating each of said at least two char fuel masses to that temperature at which said char reacts rapidly with oxygen in adjacent compressed reactant gases;

compressing at least one reactant gas into the pores of at least one of said char fuel masses;

while concurrently expanding reacted gases out of the pores of at least one other of said char fuel masses;

alternating said compression process with said expansion process for each char fuel mass, with but one of said compression or expansion processes being applied to any one char fuel mass at any one time;

repeating said compression process alternated with said expansion process several times for each of said at least two char fuel masses;

continuing said compression process continuously to at least one char fuel mass at a time;

continuing said expansion process continuously to at least one char fuel mass at a time;

removing substantially all reacted gases as product gases, which have expanded outside the pores, from continued contact with said char fuel, during each expansion on each char fuel mass;

supplying at least one fresh reactant gas for each compression on each char fuel mass, said reactant gases comprising a gas containing appreciable oxygen gas.

2. A process for gasifying at least two char fuel masses within separate containers, comprising the steps recited in claim 1:

wherein said reactant gases additionally comprise steam.

3. A process for gasifying at least two char fuel masses within separate containers, comprising the steps recited in claim 2:

wherein said reactant gases additionally comprise an oxygen rich gas whose oxygen gas content exceeds that of air.

4. A process for gasifying at least two char fuel masses within separate containers, comprising the steps recited in claim 2:

wherein said reactant gases additionally comprise a series of differing reactant gases, said series comprising at least two differing reactant gases, each of said differing reactant gases being compressed in turn into the pores of each char fuel mass while all reactant gases earlier compressed therein are still inside said pores, said differing reactant gases differing at least as to the ratio of steam to oxygen with said ratio of steam to oxygen increasing as compression proceeds for each char fuel mass;

and further comprising the steps of:

separating said reacted gases, as they expand outside the pores and through the expander and are being removed during each expansion on each char fuel mass, into a series of reacted gases, differing as to the time order of expanding out of the pores of said char fuel, said series comprising at least two separated reacted gases, a first reacted gas expanded first out of the pores of said char fuel, and a last reacted gas expanded last out of the pores of said char fuel.

5. A process for gasifying at least two char fuel masses within separate containers, comprising the steps recited in claim 3:

wherein said reactant gases additionally comprise a series of differing reactant gases, said series comprising at least two differing reactant gases, each of said differing reactant gases being compressed in turn into the pores of each char fuel mass while all reactant gases earlier compressed therein are still inside said pores, said differing reactant gases differing at least as to the ratio of steam to oxygen with said ratio of steam to oxygen increasing as compression proceeds for each char fuel mass, and also differing at least as to the ratio of oxygen gas to nitrogen with said ratio of oxygen gas to nitrogen increasing as compression proceeds for each char fuel mass;

and further comprising the steps of:

separating said reacted gases, as they expand outside the pores and through the expander and are being removed during each expansion on each char fuel mass, into a series of reacted gases, differing as to the time order of expanding out of the pores of said char fuel, said series comprising at least two separated reacted gases, a first reacted gas expanded first out of the pores of said char fuel, and a last reacted gas expanded last out of the pores of said char fuel.

6. A process for gasifying at least two char fuel masses within separate containers, comprising the steps recited in claim 2, 3, 4, or 5:

wherein said reactant gases additionally comprise a last reactant gas compressed last into each char fuel mass while all of said preceding reactant gases are still inside said pores of each char fuel mass, said last reactant gas comprising a portion of the reacted gases.

7. A functional combination of two processes for gasifying at least two char fuel masses within separate containers, a first char gasifier process and a second char gasifier process;

said first char gasifier process comprising the steps recited in claim 1, 2, 3, 4, 5, or 6:

said second char gasifier process comprising the steps of:

compressing at least one reactant gas into the pores of at least one char fuel mass;

while concurrently expanding reacted gases out of the pores of at least one other char fuel mass;

alternating said compression process with said expansion process for each char fuel mass, with but one of said compression or expansion processes being applied to any one char fuel mass at any one time;

repeating said compression process alternated with said expansion process several times for each of said at least two char fuel masses;

continuing said compression process continuously to at least one char fuel mass at a time;

continuing said expansion process continuously to at least one char fuel mass at a time;

removing substantially all reacted gases as product gases, which have expanded outside the pores, from continued contact with said char fuel, during each expansion on each char fuel mass;

supplying at least one fresh reactant gas for each compression on each char fuel mass, said reactant gases into said second char gasifier process being a portion of the reacted gases from said first char gasifier process.

8. A functional combination of two processes for gasifying at least two char fuel masses within separate containers, a first char gasifier process and a second char gasifier process;

said first char gasifier process comprising the steps recited in claim 1, 2, 3, 4, 5, and 6:

said second char gasifier process comprising the steps of:

cooling reactant gases before they are compressed;

compressing said reactant gases into the pores of at least one char fuel mass and heating said reactant gases after compressing and before said gases enter the pores of said char fuel;

while concurrently expanding reacted gases out of the pores of at least one other char fuel mass; alternating said compression and heating processes with said expansion process for each char fuel mass, with but one of said compression or expansion processes being applied to any one char fuel mass at any one time;

repeating said compression and heating processes alternated with said expansion process several times for each of at least two char fuel masses;

continuing said compression and heating processes continuously to at least one char fuel mass at a time;

continuing said expansion process continuously to at least one char fuel mass at a time;

removing substantially all reacted gases as product gases, which have expanded outside the pores, from continued contact with said char fuel, during each expansion on each char fuel mass;

supplying fresh reactant gas for each compression on each char fuel mass, said reactant gases into said second char gasifier process being a portion of the reacted gases from said first char gasifier process.

* * * * *

UNITED STATES PATENT AND TRADEMARK OFFICE

CERTIFICATE OF CORRECTION

PATENT NO. : 4,568,361

DATED : February 4, 1986

INVENTOR(S) : Joseph C. Firey

It is certified that error appears in the above-identified patent and that said Letters Patent is hereby corrected as shown below:

Col. 9 line 22: change, "0.045," to, -- 0.45 --.
Col. 12 line 48: change, "devolatilier," to, -- devolatilizer --.
Col. 13 line 49: change, "devolitization," to, -- devolatilization --.
Col. 15 line 43: change, "ful," to, -- full --.

Col. 18 line 4: change, "gasificaion," to -- gasification --.
Col. 18 lines 54 and 55: delete the first words, " Not shown in Fig. 1 are, a means for rotating the refuel valve body, 3,".
Col. 28 lines 45 and 46: delete the first words, "and also is similarly connected in sequence to these stages."
Col. 29 line 4: change, "longg," to, -- long --.
Col. 30 line 47: change, "(mmch)/(mmch)", to, -- (mchr)/(mmch) --.
Col. 31 line 25: change, "(VR)(tc)," to, -- (VR)/(tc) --.
Col. 31 line 29: change, "produce," to, -- product --.
Col. 34 line 21: change, "T1," to -- R1 --.
Col. 34 line 39: change,"Wbere," to, -- Where --.
Col. 36 line 62: change, "expsnd," to, -- expand --.
Col. 42 line 5: change, "if," to, -- is --.
Col. 42 lines 33 and 34: add the words, -- work output and --, between lines 33 and 34.

UNITED STATES PATENT AND TRADEMARK OFFICE

CERTIFICATE OF CORRECTION

PATENT NO. : 4,568,361

DATED : February 4, 1986

INVENTOR(S) : Joseph C. Firey

It is certified that error appears in the above-identified patent and that said Letters Patent is hereby corrected as shown below:

Col. 45 line 18: change, "nressure, "to, -- pressure --.
Col. 46 line 20: change, "complete," to, -- completed --.
Col. 50 line 2: change, "and," to, -- or --.

Signed and Sealed this

*Seventeenth* Day of *June 1986*

[SEAL]

*Attest:*

DONALD J. QUIGG

*Attesting Officer* *Commissioner of Patents and Trademarks*